US005813480A

United States Patent [19]

Zaleski, Jr. et al.

[11] Patent Number: 5,813,480

[45] Date of Patent: Sep. 29, 1998

[54] METHOD AND APPARATUS FOR MONITORING AND RECORDING OF OPERATING CONDITIONS OF A DOWNHOLE DRILL BIT DURING DRILLING OPERATIONS

[75] Inventors: Theodore Edward Zaleski, Jr., Houston; Scott Ray Schmidt, The Woodlands, both of Tex.

[73] Assignee: Baker Hughes Incorporated, Houston, Tex.

[21] Appl. No.: 760,122

[22] Filed: Dec. 3, 1996

Related U.S. Application Data

[63] Continuation of Ser. No. 643,909, May 7, 1996, which is a continuation of Ser. No. 390,322, Feb. 16, 1995, abandoned.

[51] Int. Cl.[6] ..... E21B 10/00; E21B 47/12; E21B 12/02

[52] U.S. Cl. ..... 175/40

[58] Field of Search ..... 175/34, 40, 50; 340/853.1, 853.3

[56] References Cited

U.S. PATENT DOCUMENTS

| | | | |
|---|---|---|---|
| 2,249,769 | 11/1941 | Leonardon . | |
| 2,575,173 | 11/1951 | Johnson . | |
| 3,058,532 | 10/1962 | Alder . | |
| 3,455,158 | 7/1969 | Richter, Jr. et al. | 73/154 |
| 3,678,883 | 7/1972 | Fischer | 116/114 |
| 3,853,184 | 12/1974 | McCullough | 175/39 |
| 3,865,736 | 2/1975 | Fries | 252/11 |
| 3,968,473 | 7/1976 | Patton et al. | 340/18 |
| 4,001,774 | 1/1977 | Dawson et al. . | |
| 4,040,003 | 8/1977 | Beynet et al. | 340/18 |
| 4,346,591 | 8/1982 | Evans | 73/151 |
| 4,403,664 | 9/1983 | Sullinger . | |
| 4,445,578 | 5/1984 | Millheim . | |
| 4,548,280 | 10/1985 | Daly et al. . | |
| 4,596,293 | 6/1986 | Wallussek et al. . | |
| 4,655,300 | 4/1987 | Davis, Jr. et al. | 175/39 |
| 4,695,957 | 9/1987 | Peltier . | |
| 4,721,172 | 1/1988 | Brett et al. . | |
| 4,785,894 | 11/1988 | Davis, Jr. et al. | 175/39 |

(List continued on next page.)

FOREIGN PATENT DOCUMENTS

| | | |
|---|---|---|
| 546119 | 8/1985 | Australia . |
| 0 377 235 A1 | 11/1990 | European Pat. Off. . |
| 2 043 747 | 8/1980 | United Kingdom . |
| 2 247 477 | 4/1992 | United Kingdom . |
| 2 261 308 | 12/1993 | United Kingdom . |
| WO 92/18882 | 10/1992 | WIPO . |
| WO 93/06339 | 1/1993 | WIPO . |

*Primary Examiner*—William P. Neuder
*Attorney, Agent, or Firm*—Melvin A. Hunn

[57] ABSTRACT

The present invention is directed to an improved method and apparatus for monitoring and recording of operating conditions of a downhole drill bit during drilling operations. The invention may be alternatively characterized as either (1) an improved downhole drill bit, or (2) a method of monitoring at least one operating condition of a downhole drill bit during drilling operations in a wellbore, or (3) a method of manufacturing an improved downhole drill bit. When characterized as an improved downhole drill bit, the present invention includes (1) an assembly including at least one bit body, (2) a coupling member formed at an upper portion of the assembly, (3) at least one operating conditioning sensor carried by the improved downhole drill bit for monitoring at least one operating condition during drilling operations, and (4) at least one memory means, located in and carried by the drill bit body, for recording in memory data pertaining to the at least one operating condition. Optionally, the improved downhole drill bit of the present invention may cooperate with a communication system for communicating information away from the improved downhole drill bit during drilling operations, preferably ultimately to a surface location. The improved downhole drill bit of the present invention may further include a processor member, which is located in and carried by the drill bit body, for performing at least one predefined analysis of the data pertaining to the at least one operating condition, which has been recorded by the at least one memory means.

88 Claims, 15 Drawing Sheets

U.S. PATENT DOCUMENTS

| | | | |
|---|---|---|---|
| 4,785,895 | 11/1988 | Davis, Jr. et al. | 175/39 |
| 4,788,544 | 11/1988 | Howard | 340/853 |
| 4,866,607 | 9/1989 | Anderson et al. . | |
| 4,884,071 | 11/1989 | Howard | 340/854 |
| 4,903,245 | 2/1990 | Close et al. . | |
| 4,958,125 | 9/1990 | Jardine et al. . | |
| 5,010,765 | 4/1991 | Duckworth et al. . | |
| 5,159,577 | 10/1992 | Twist . | |
| 5,160,925 | 11/1992 | Dailey et al. . | |
| 5,163,521 | 11/1992 | Pustanyk et al. . | |
| 5,165,490 | 11/1992 | Nosaka | 175/45 |
| 5,182,516 | 1/1993 | Ward et al. | 324/326 |
| 5,226,332 | 7/1993 | Wassell . | |
| 5,363,926 | 11/1994 | Mizuno | 175/45 |
| 5,390,153 | 2/1995 | Scherbatskoy | 175/40 X |
| 5,415,030 | 5/1995 | Jogi et al. | 175/39 X |
| 5,448,227 | 9/1995 | Oiban et al. | 175/40 |
| 5,465,798 | 11/1995 | Edlund et al. | 175/40 X |
| 5,475,309 | 12/1995 | Hong et al. | 324/338 |
| 5,493,288 | 2/1996 | Henneuse | 340/854 |
| 5,501,285 | 3/1996 | Lamine et al. | 175/27 |

METHOD AND APPARATUS FOR MONITORING AND RECORDING OF OPERATING CONDITIONS OF A DOWNHOLE DRILL BIT DURING DRILLING OPERATIONS

This is a continuation of application Ser. No. 08/643,909, filed May 7, 1996, which is a continuation of application Ser. No. 08/390,322, filed Feb. 16, 1995, now abandoned.

BACKGROUND OF THE INVENTION

1. Field of the Invention

The present application relates in general to oil and gas drilling operations, and in particular to an improved method and apparatus for monitoring the operating conditions of a downhole drill bit during drilling operations.

2. Description of the Prior Art

The oil and gas industry expends sizable sums to design cutting tools, such as downhole drill bits such as rolling cone rock bits and fixed cutter bits, which have relatively long service lives, with relatively infrequent failure. In particular, considerable sums are expended to design and manufacture rolling cone rock bits and fixed cutter bits in a manner which minimizes the opportunity for catastrophic drill bit failure during drilling operations. The loss of a cone or cutter compacts during drilling operations can impede the drilling operations and necessitate rather expensive fishing operations which can exceed over one million dollars in cost. If the fishing operations fail, side track drilling operations must be performed in order to drill around the portion of the wellbore which includes the lost cones or compacts. Typically, during drilling operations, bits are pulled and replaced with new bits even though significant service could be obtained from the replaced bit. These premature replacements of downhole drill bits are expensive, since each trip out of the wellbore prolongs the overall drilling activity, and consumes considerable manpower, but are nevertheless done in order to avoid the far more disruptive and expensive fishing and side track drilling operations necessary if one or more cones or compacts are lost due to bit failure.

SUMMARY OF THE INVENTION

The present invention is directed to an improved method and apparatus for monitoring and recording of operating conditions of a downhole drill bit during drilling operations. The invention may be alternatively characterized as either (1) an improved downhole drill bit, or (2) a method of monitoring at least one operating condition of a downhole drill bit during drilling operations in a wellbore, or (3) a method of manufacturing an improved downhole drill bit.

When characterized as an improved downhole drill bit, the present invention includes (1) an assembly including at least one bit body, (2) a coupling member formed at an upper portion of the assembly, (3) at least one operating conditioning sensor carried by the improved downhole drill bit for monitoring at least one operating condition during drilling operations, and (4) at least one memory means, located in and carried by the drill bit body, for recording in memory data pertaining to the at least one operating condition.

Preferably the improved downhole drill bit of the present invention cooperates with a data reader which may be utilized to recover data pertaining to the at least one operating condition which has been recorded in the at least one memory means, either during drilling operations, or after the improved downhole drill bit has been pulled from the wellbore. Optionally, the improved downhole drill bit of the present invention may cooperate with a communication system for communicating information away from the improved downhole drill bit during drilling operations, preferably ultimately to a surface location.

The improved downhole drill bit of the present invention may further include a processor member, which is located in and carried by the drill bit body, for performing at least one predefined analysis of the data pertaining to the at least one operating condition, which has been recorded by the at least one memory means. Examples of the types of analyses which may be performed on the recorded data include analysis of strain at particular portions of the improved downhole drill bit during drilling operations, an analysis of temperature at particular locations on the improved downhole drill bit during drilling operations, analysis of at least one operating condition of the lubrication systems of the improved downhole drill bit during drilling operations, and analysis of acceleration of the improved downhole drill bit during drilling operations.

In accordance with the present invention, the recorded data may be analyzed either during drilling operations, or after the downhole drill bit has been removed from the wellbore. Analysis which is performed during drilling operations may be utilized to define the current operating condition of the improved downhole drill bit, and may optionally be utilized to communicate warning signals to a surface location which indicate impending failure, and which may be utilized by the drilling operator in making a determination of whether to replace the downhole drill bit, or to continue drilling under different drilling conditions.

The improved downhole drill bit of the present invention may be designed and manufactured in accordance with the following method. A plurality of operating conditions sensors are placed in at least one test downhole drill bit. Then, the at least one test downhole drill bit is subjected to at least one simulated drilling operation. Data is recorded with the plurality of operating condition sensors during the simulated drilling operations. Next, the data is analyzed to identify impending downhole drill bit failure indicators. Selected ones of the plurality of operating condition sensors are identified as providing either more useful data, or a better indication of impending downhole drill bit failure. Those selected ones of the plurality of operating condition sensors are then included in production downhole drill bits. Included in this production downhole drill bit is at least one electronic memory for recording sensor data. Also optionally included in the production downhole drill bits is a monitoring system for comparing data obtained during drilling operations with particular ones of the impending downhole drill bit failure indicators. When the production downhole drill bits are utilized during drilling operations, in one contemplated use, the monitoring system is utilized to identify impending downhole drill bit failure, and data is telemetered uphole during drilling operations to provide an indication of impending downhole drill bit failure.

In accordance with the preferred embodiment of the present invention, the monitoring system is preferably carried entirely within the production downhole drill bit, along with a memory means for recording data sensed by the operating condition sensors, but in alternative embodiments, a rather more complicated drilling assembly is utilized, including drilling motors, and the like, and the memory means, and optional monitoring system, is carried by the drill assembly and in particular in the downhole drill bit.

The present invention may also be characterized as a method of monitoring at least one operating condition of a downhole drill bit, during drilling operations in a wellbore. The method may include a number of steps. A downhole drill bit is provided. At least one operating condition sensor is located in or near the downhole drill bit. At least one electronic memory unit is also located in the downhole drill bit. The downhole drill bit is secured to a drill string and lowered into a wellbore. The downhole drill bit is utilized to disintegrate geologic formations during drilling operations. At least one operating condition sensor is utilized to monitor at least one operating condition during the step of disintegrating geologic formations with the downhole drill bit. The at least one electronic memory is utilized to record data pertaining to the at least one operating condition during the step of disintegrating geologic formation with the downhole drill bit. The method of monitoring optionally includes a step of communicating information to at least one particular wellbore location during the step of disintegrating geologic formations with the downhole drill bit. Alternatively, the method includes the steps of locating a processor member in the downhole drill bit, and utilizing the processor member to perform at least one predetermined analysis of data pertaining to the at least one operating condition during the step of disintegrating geologic formations of the downhole drill bit. In still another alternative embodiment, the method includes the steps of retrieving the downhole drill bit from the wellbore, and reviewing the data pertaining to the at least one operating condition.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference, to the following detailed description of an illustrative embodiment when read in conjunction with the accompanying drawings, wherein:

DETAILED DESCRIPTION OF THE INVENTION

1. OVERVIEW OF DRILLING OPERATIONS

Figure 1:
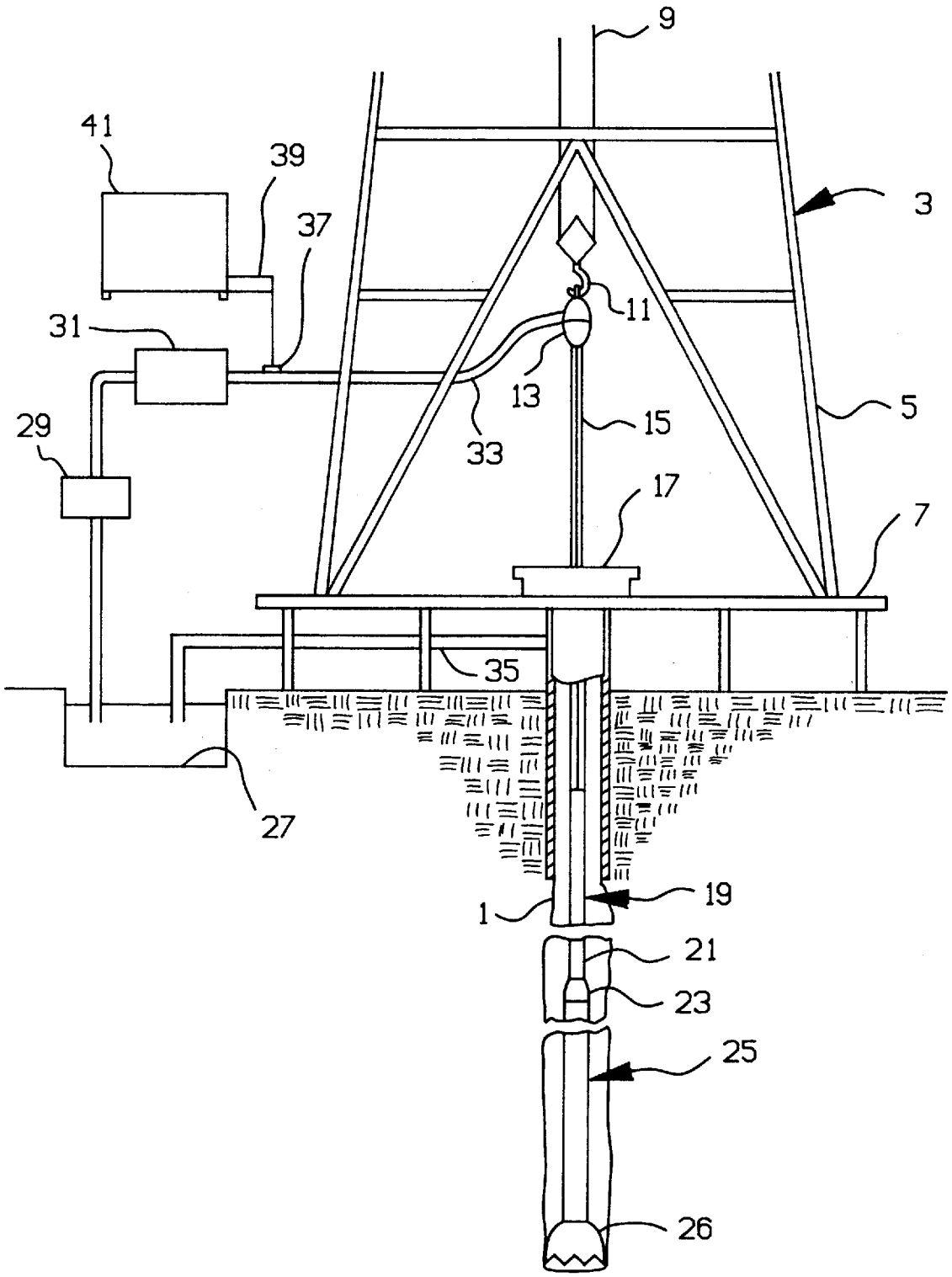
FIG. 1 depicts drilling operations conducted utilizing an improved downhole drill bit in accordance with the present invention, which includes a monitoring system for monitoring at least one operating condition of the downhole drill bit during the drilling operations.

FIG. 1 depicts one example of drilling operations conducted in accordance with the present invention with an improved downhole drill bit which includes within it a memory device which records sensor data during drilling operations. As is shown, a conventional rig 3 includes a derrick 5, derrick floor 7, draw works 9, hook 11, swivel 13, kelly joint 15, and rotary table 17. A drillstring 19 which includes drill pipe section 21 and drill collar section 23 extends downward from rig 3 into wellbore 1. Drill collar section 23 preferably includes a number of tubular drill collar members which connect together, including a measurement-while-drilling logging subassembly and cooperating mud pulse telemetry data transmission subassembly, which are collectively referred to hereinafter as "measurement and communication system 25".

During drilling operations, drilling fluid is circulated from mud pit 27 through mud pump 29, through a desurger 31, and through mud supply line 33 into swivel 13. The drilling mud flows through the kelly joint and an axial central bore in the drillstring. Eventually, it exists through jets which are located in downhole drill bit 26 which is connected to the lowermost portion of measurement and communication system 25. The drilling mud flows back up through the annular space between the outer surface of the drillstring and the inner surface of wellbore 1, to be circulated to the surface where it is returned to mud pit 27 through mud return line 35. A shaker screen (which is not shown) separates formation cuttings from the drilling mud before it returns to mud pit 27.

Preferably, measurement and communication system 25 utilizes a mud pulse telemetry technique to communicate data from a downhole location to the surface while drilling operations take place. To receive data at the surface, transducer 37 is provided in communication with mud supply line 33. This transducer generates electrical signals in response to drilling mud pressure variations. These electrical signals are transmitted by a surface conductor 39 to a surface electronic processing system 41, which is preferably a data processing system with a central processing unit for executing program instructions, and for responding to user commands entered through either a keyboard or a graphical pointing device.

The mud pulse telemetry system is provided for communicating data to the surface concerning numerous downhole conditions sensed by well logging transducers or measurement systems that are ordinarily located within measurement and communication system 25. Mud pulses that define the data propagated to the surface are produced by equipment which is located within measurement and communication system 25. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by surface transducer 37. Such a telemetry system is described and explained in U.S. Pat. No. 4,216,536 to More, which is incorporated herein by reference as if fully set forth. An alternative conventional arrangement generates and transmits positive pressure pulses. As is conventional, the circulating mud provides a source of energy for a turbine-driven generator subassembly which is located within measurement and communication system 25. The turbine-driven generator generates electrical power for the pressure pulse generator and for various circuits including those circuits which form the operational components of the measurement-while-drilling tools. As an alternative or supplemental source of electrical power, batteries may be provided, particularly as a back-up for the turbine-driven generator.

2. UTILIZATION OF THE INVENTION IN ROLLING CONE ROCKETS

Figure 2:
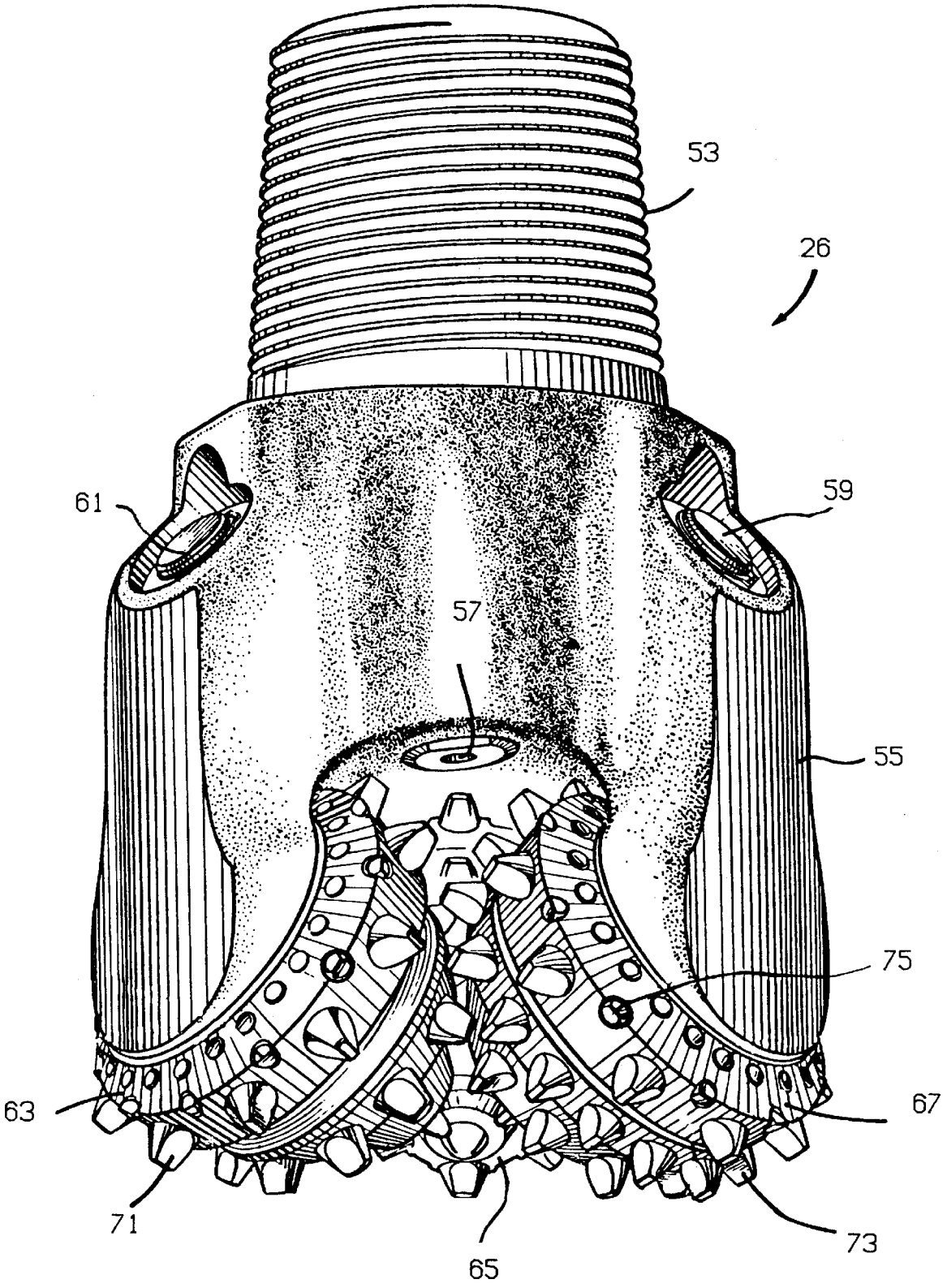
FIG. 2 is a perspective view of an improved downhole drill bit.

FIG. 2 is a perspective view of an improved downhole drill bit 26 in accordance with the present invention. The downhole drill bit includes an externally-threaded upper end 53 which is adapted for coupling with an internally-threaded box end of the lowermost portion of the drillstring. Additionally, it includes bit body 55. Nozzle 57 (and other obscured nozzles) jets fluid that is pumped downward through the drillstring to cool downhole drill bit 26, clean the cutting teeth of downhole drill bit 26, and transport the cuttings up the annulus. Improved downhole drill bit 26 includes three bit legs (but may alternatively include a lesser or greater number of legs) which extend downward from bit body 55, which terminate at journal bearings (not depicted in FIG. 2 but depicted in FIG. 3, but which may alternatively include any other conventional bearing, such as a roller bearing) which receive rolling cone cutters 63, 65, 67. Each of rolling cone cutters 63, 65, 67 is lubricated by a lubrication system which is accessed through compensator caps 59, 60 (obscured in the view of FIG. 2), and 61. Each of rolling cone cutters 63, 65, 67 include cutting elements, such as cutting elements 71, 73, and optionally include gage trimmer inserts, such as gage trimmer insert 75. As is conventional, cutting elements may comprise tungsten carbide inserts which are press fit into holes provided in the rolling cone cutters. Alternatively, the cutting elements may be machined from the steel which forms the body of rolling cone cutters 63, 65, 67. The gage trimmer inserts, such as gage trimmer insert 75, are press fit into holes provided in the rolling cone cutters 63, 65, 67. No particular type, construction, or placement of the cutting elements is required for the present invention, and the drill bit depicted in FIGS. 2 and 3 is merely illustrative of one widely available downhole drill bit.

Figure 3:
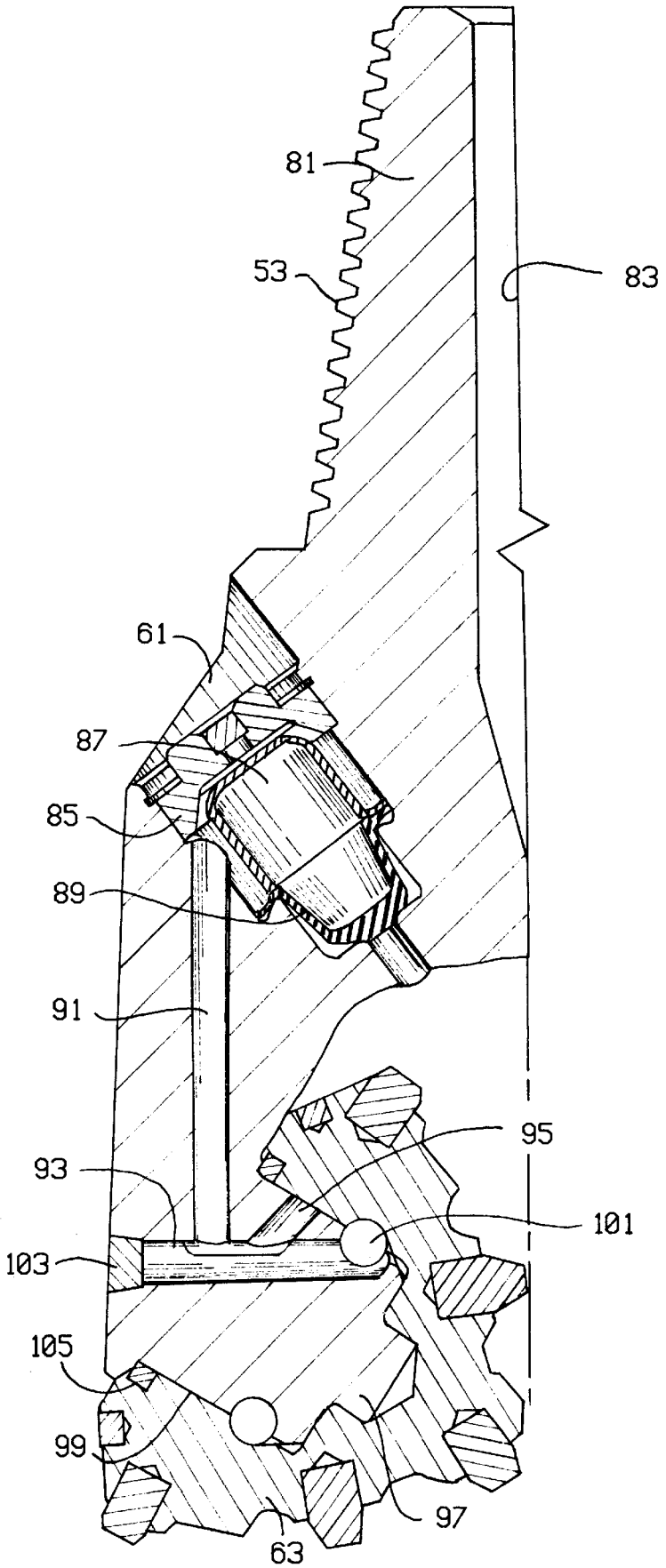
FIG. 3 is a one-quarter longitudinal section view of the downhole drill bit depicted in FIG. 2.

FIG. 3 is a one-quarter longitudinal section view of the improved downhole drill bit 26 of FIG. 2. One bit leg 81 is depicted in this view. Central bore 83 is defined interiorly of bit leg 81. Externally threaded pin 53 is utilized to secure downhole drill bit 26 to an adjoining drill collar member. In alternative embodiments, any conventional or novel coupling may be utilized. A lubrication system 85 is depicted in the view of FIG. 3 and includes compensator 87 which includes compensator diaphragm 89, lubrication passage 91, lubrication passage 93, and lubrication passage 95. Lubrication passages 91, 93, and 95 are utilized to direct lubricant from compensator 97 to an interface between rolling cone cutter 63 and cantilevered journal bearing 97, to lubricate the mechanical interface 99 thereof. Rolling cone cutter 63 is secured in position relative to cantilevered journal bearing 97 by ball lock 101 which is moved into position through lubrication passage 93 through an opening which is filled by plug weld 103. The interface 99 between cantilevered journal bearing 97 and rolling cone cutter 63 is sealed by o-ring seal 105; alternatively, a rigid or mechanical face seal may be provided in lieu of an o-ring seal. Lubricant which is routed from compensator 87 through lubrication passages 91, 93, and 95 lubricates interface 99 to facilitate the rotation of rolling cone cutter 63 relative to cantilevered journal bearing 97. Compensator 87 may be accessed from the exterior of downhole drill bit 26 through removable compensator cap 61. In order to simplify this exposition, the plurality of operating condition sensors which are placed within downhole drill bit 26 are not depicted in the view of FIG. 3. The operating condition sensors are however shown in their positions in the views of FIGS. 8A through 8H.

3. OVERVIEW OF DATA RECORDATION AND PROCESSING

Figure 4:
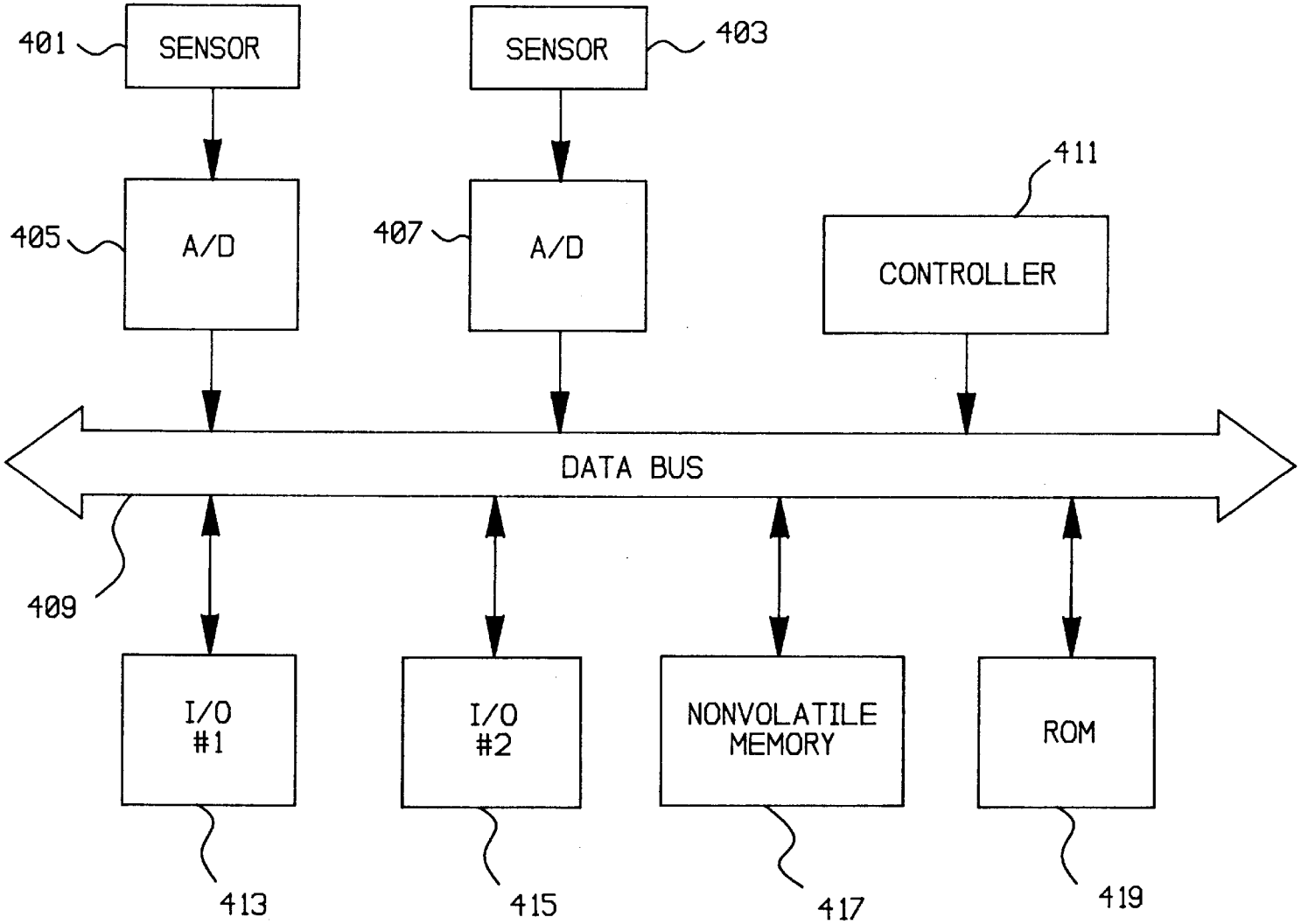
FIG. 4 is a block diagram of the components which are utilized to perform signal processing, data analysis, and communication operations.

FIG. 4 is a block diagram representation of the components which are utilized to perform signal processing, data analysis, and communication operations, in accordance with the present invention. As is shown therein, sensors, such as sensors 401, 403, provide analog signals to analog-to-digital converters 405, 407, respectively. The digitized sensor data is passed to data bus 409 for manipulation by controller 411. The data may be stored by controller 411 in nonvolatile memory 417. Program instructions which are executed by controller 411 may be maintained in ROM 419, and called for execution by controller 411 as needed. Controller 411 may comprise a conventional microprocessor which operates on eight or sixteen bit binary words. Controller 411 may be programmed to administer merely the recordation of sensor data in memory, in the most basic embodiment of the present invention; however, in more elaborate embodiments of the present invention, controller 411 may be utilized to perform analyses of the sensor data in order to detect impending failure of the downhole drill bit and/or to supervise communication of the processed or unprocessed sensor data to another location within the drillstring or wellbore. The preprogrammed analyses may be maintained in memory in ROM 419, and loaded onto controller 411 in a conventional manner, for execution during drilling operations. In still more elaborate embodiments of the present invention, controller 411 may pass digital data and/or warning signals indicative of impending downhole drill bit failure to input/output devices 413, 415 for communication to either another location within the wellbore or drillstring, or to a surface location. The input/output devices 413, 415 may be also utilized for reading recorded sensor data from nonvolatile memory 417 at the termination of drilling operations for the particular downhole drill bit, in order to facilitate the analysis of the bit's drill performance during drilling operation. Alternatively, a wireline reception device may be lowered within the drillstring during drilling operations to receive data which is transmitted by input/output device 413, 415 in the form of electromagnetic transmissions.

4. EXEMPLARY USES OF RECORDED AND/OR PROCESSED DATA

One possible use of this data is to determine whether the purchaser of the downhole drill bit has operated the downhole drill bit in a responsible manner; that is, in a manner which is consistent with the manufacturer's instruction. This may help resolve conflicts and disputes relating to the performance or failure in performance of the downhole drill bit. It is beneficial for the manufacturer of the downhole drill bit to have evidence of product misuse as a factor which may indicate that the purchaser is responsible for financial loss instead of the manufacturer. Still other uses of the data include the utilization of the data to determine the efficiency and reliability of particular downhole drill bit designs. The manufacturer may utilize the data gathered at the completion of drilling operations of a particular downhole drill bit in order to determine the suitability of the downhole drill bit for that particular drilling operation. Utilizing this data, the downhole drill bit manufacturer may develop more sophisticated, durable, and reliable designs for downhole drill bits. The data may alternatively be utilized to provide a record of the operation of the bit, in order to supplement resistivity and other logs which are developed during drilling operations, in a conventional manner. Often, the service companies which provide measurement-while-drilling operations are hard pressed to explain irregularities in the logging data. Having a complete record of the operating conditions of the downhole drill bit during the drilling operations in question may allow the provider of measurement-while-drilling services to explain irregularities in the log data. Many other conventional or novel uses may be made of the recorded data which either improve or enhance drilling operations, the control over drilling operations, or the manufacture, design and use of drilling tools. The most important of all possible uses is the use of the present invention to obtain the full utilization of bit life through either real-time monitoring, forensic use of recorded data, or a combination of both.

5. EXEMPLARY ELECTRONIC MEMORY

Figure 5:
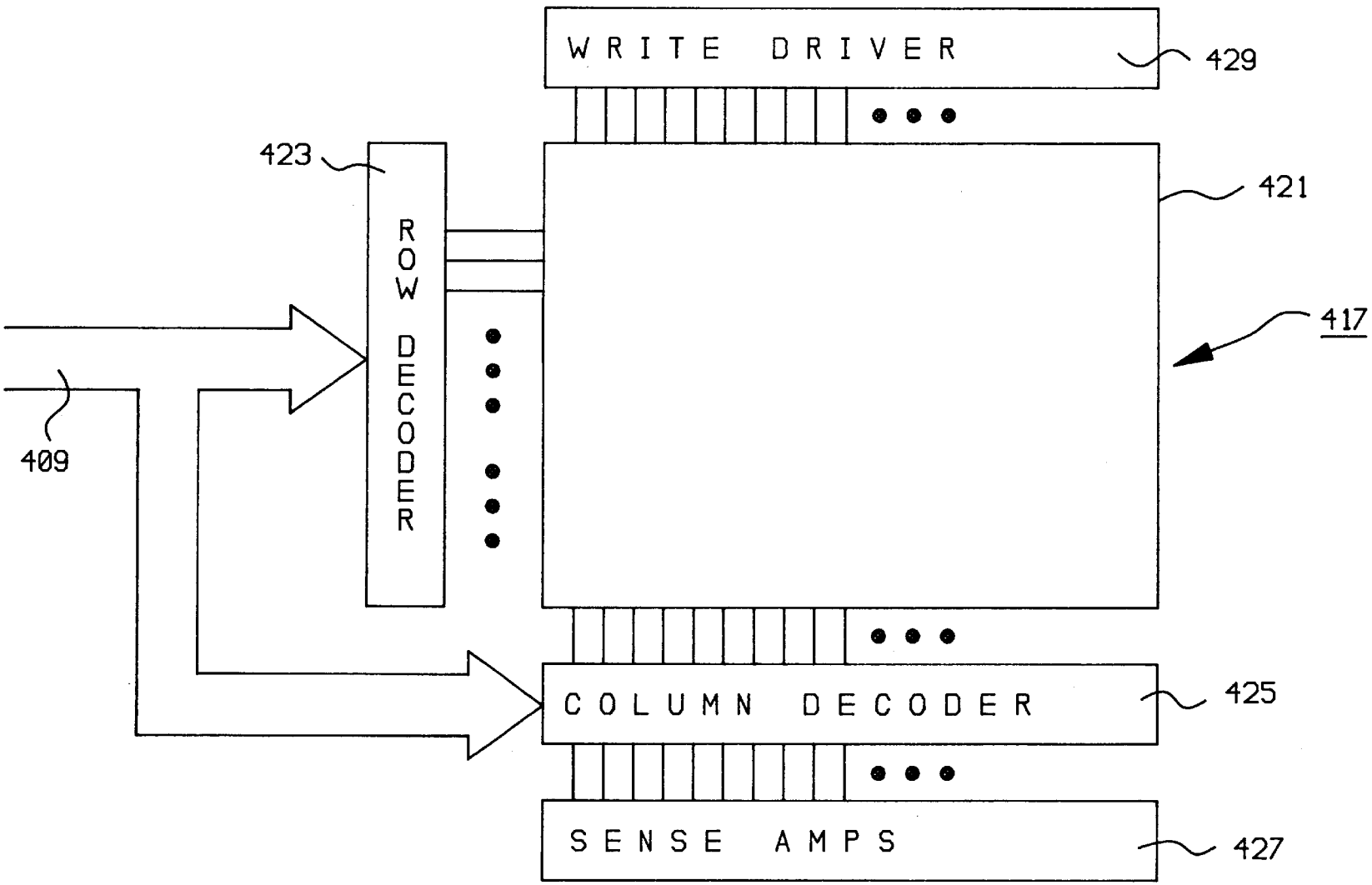
FIG. 5 is a block diagram depiction of electronic memory utilized in the improved downhole drill bit to record data.

FIG. 5 is a block diagram depiction of electronic memory utilized in the improved downhole drill bit of the present invention to record data. Nonvolatile memory 417 includes a memory array 421. As is known in the art, memory array 421 is addressed by row decoder 423 and column decoder 425. Row decoder 423 selects a row of memory array 417 in response to a portion of an address received from the address bus 409. The remaining lines of the address bus 409 are connected to column decoder 425, and used to select a subset of columns from the memory array 417. Sense amplifiers 427 are connected to column decoder 425, and sense the data provided by the cells in memory array 421. The sense amps provide data read from the array 421 to an output (not shown), which can include latches as is well known in the art. Write driver 429 is provided to store data into selected locations within the memory array 421 in response to a write control signal.

The cells in the array 421 of nonvolatile memory 417 can be any of a number of different types of cells known in the art to provide nonvolatile memory. For example, EEPROM memories are well known in the art, and provide a reliable, erasable nonvolatile memory suitable for use in applications such as recording of data in wellbore environments. Alternatively, the cells of memory array 421 can be other designs known in the art, such as SRAM memory arrays utilized with battery back-up power sources.

6. SELECTION OF SENSORS

In accordance with the present invention, one or more operating condition sensors are carried by the production downhole drill bit, and are utilized to detect a particular operating condition. One possible technique for determining which particular sensors are included in the production downhole drill bits will now be described in detail.

In accordance with the present invention, a plurality of operating condition sensors may be placed on at least one test downhole drill bit. Preferably, a large number of test downhole drill bits are examined. The test downhole drill bits may then be subjected to at least one simulated drilling operation, and data may be recorded with respect to time with the plurality of operating condition sensors. The data may then be examined to identify impending downhole drill bit failure indicators. Then, selected ones of the plurality of operating condition sensors may be selected for placement in production downhole drill bits. Optionally, in each production downhole drill bit a monitoring system may be provided for comparing data obtained during drilling operations with particular ones of the impending downhole drill bit failure indicators. In one particular embodiment, drilling operations are then conducted with the production downhole drill bit, and the monitoring system may be utilized to identify impending downhole drill bit failure. Finally, and optionally, the data may be telemetered uphole during drilling operations to provide an indication of impending downhole drill bit failure utilizing any one of a number of known, prior art data communications systems.

The types of sensors which may be utilized during simulated drilling operations are set forth in block diagram form in FIG. 6, and will now be discussed in detail.

Bit leg 80 may be equipped with strains sensors 125 in order to measure axial strain, shear strain, and bending strain. Bit leg 81 may likewise be equipped with strain sensors 127 in order to measure axial strain, shear strain, and bending strain. Bit leg 82 may also equipped with strain sensors 129 for measuring axial strain, shear strain, and bending strain.

Journal bearing 96 may be equipped with temperature sensors 131 in order to measure the temperature at the cone mouth, thrust face, and shirt tail of the cantilevered journal bearing 97; likewise, journal bearing 97 may be equipped with temperature sensors 133 for measuring the temperature at the cone mouth, thrust face, and shirt tail of the cantilevered journal bearing 97; journal bearing 98 may be equipped with temperature sensors 135 at the cone mouth, thrust face, and shirt tail of cantilevered journal bearing 98 in order to measure temperature at those locations. In alternative embodiments, different types of bearings may be utilized, such as roller bearings. Temperature sensors would be appropriately located therein.

Lubrication system may be equipped with reservoir pressure sensor 137 and pressure at seal sensor 139 which together are utilized to develop a measurement of the differential pressure across the seal of journal bearing 96. Likewise, lubrication system 85 may be equipped with reservoir pressure sensor 141 and pressure at seal sensor 143 which develop a measurement of the pressure differential across the seal at journal bearing 97. The same is likewise true for lubrication system 86 which may be equipped with reservoir pressure sensor 145 and pressure at seal sensor 147 which develop a measurement of the pressure differential across the seal of journal bearing 98.

Additionally, acceleration sensors 149 may be provided on bit body 55 in order to measure the x-axis, y-axis, and z-axis components of acceleration experienced by bit body 55.

Finally, ambient pressure sensor 151 and ambient temperature sensor 153 may be provided to monitor the ambient pressure and temperature of wellbore 1.

Additional sensors may be provided in order to obtain and record data pertaining to the wellbore and surrounding formation, such as, for example and without limitation, sensors which provide an indication about one or more electrical or mechanical properties of the wellbore or surrounding formation.

Figure 6:
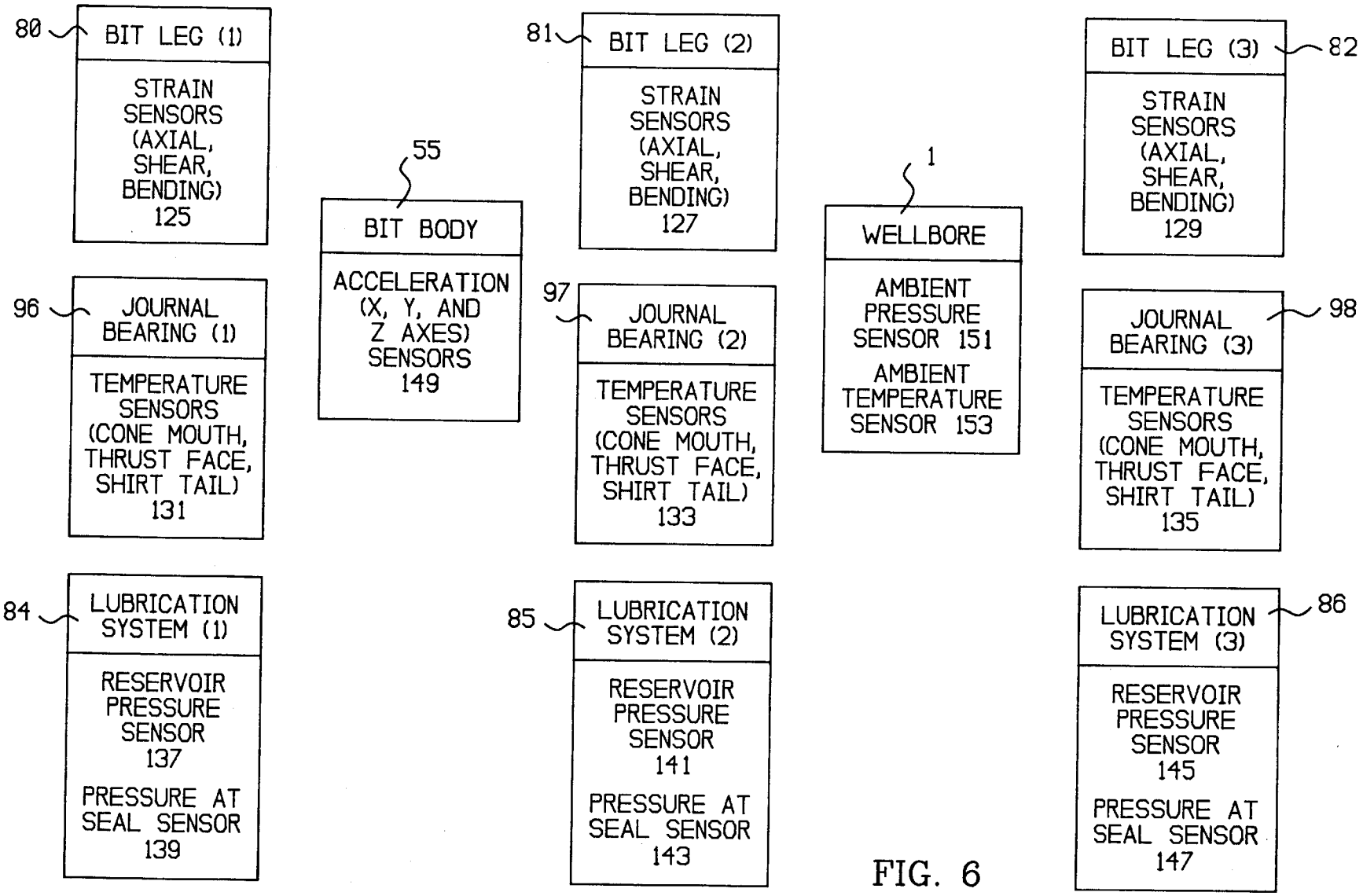
FIG. 6 is a block diagram depiction of particular types of operating condition sensors which may be utilized in the improved downhole drill bit of the present invention.
Figure 7A:
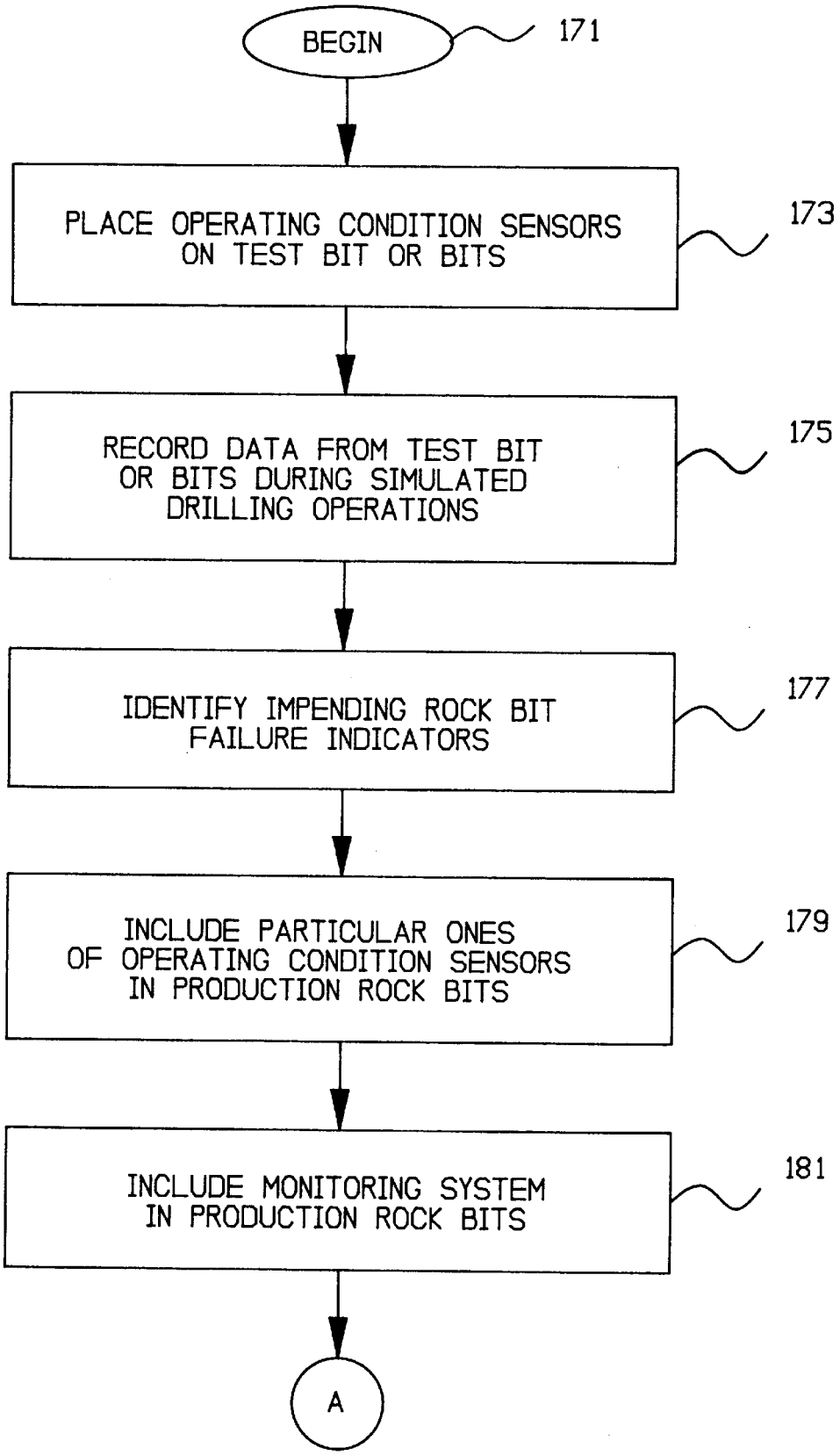
FIGS. 7A and 7B are a flowchart representation of the method steps utilized in constructing an improved downhole drill bit in accordance with the present invention.
Figure 7B:
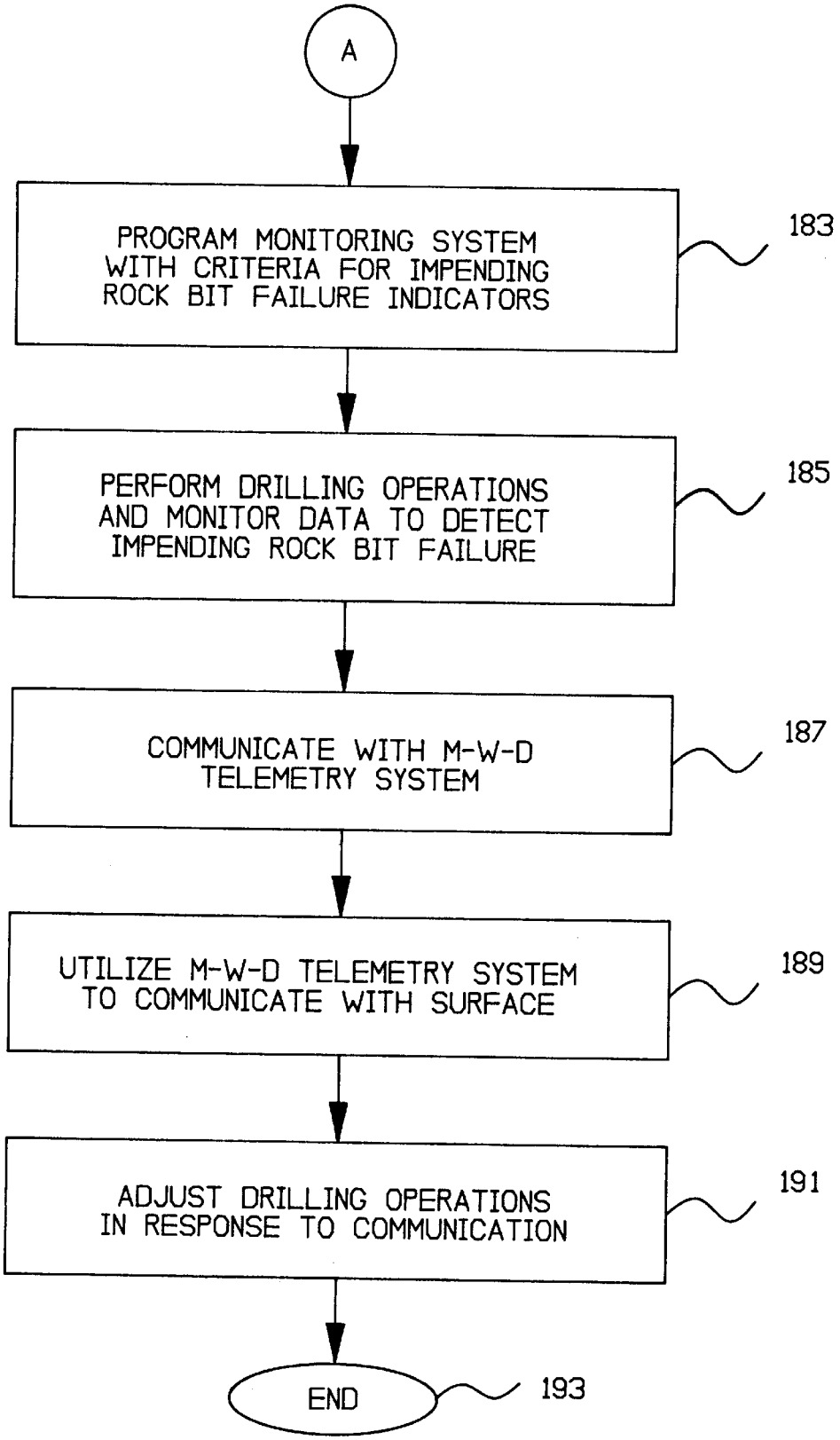

The overall technique which may be used for establishing an improved downhole drill bit with a monitoring system is set forth in flowchart form in FIGS. 7A and 7B. The process begins at step 171, and continues in step 173 by the placement of operating condition sensors, such as those depicted in block diagram in FIG. 6, on a test bit or bits for which a monitoring system is desired. The test bits are then subjected to simulated drilling operations, in accordance with step 175, and data from the operating condition sensors is recorded. Utilizing the particular sensors depicted in block diagram in FIG. 6, information relating to the strain detected at bit legs 80, 81, and 82 will be recorded. Additionally, information relating to the temperature detected at journal bearings 96, 97, and 98 will also be recorded. Furthermore, information pertaining to the pressure within lubrication systems 84, 85, 86 will be recorded. Information pertaining to the acceleration of bit body 55 will be recorded. Finally, ambient temperature and pressure within the simulated wellbore will be recorded.

7. EXEMPLARY FAILURE INDICATORS

Optionally, the collected data may be examined to identify indicators for impending downhole drill bit failure. Such indicators include, but are not limited to, some of the following:

(1) a seal failure in lubrication systems 84, 85, or 86 will result in a loss of pressure of the lubricant contained within the reservoir; a loss of pressure at the interface between the cantilevered journal bearing and the rolling cone cutter likewise indicates a seal failure;

(2) an elevation of the temperature as sensed at the cone mouth, thrust face, and shirt tail of journal bearings 96, 97, or 98 likewise indicates a failure of the lubrication system, but may also indicate the occurrence of drilling inefficiencies such as bit balling or drilling motor inefficiencies or malfunctions;

(3) excessive axial, shear, or bending strain as detected at bit legs 80, 81, or 82 will indicate impending bit failure, and in particular will indicate physical damage to the rolling cone cutters;

(4) irregular acceleration of the bit body indicates a cutter malfunction.

The simulated drilling operations are preferably conducted using a test rig, which allows the operator to strictly control all of the pertinent factors relating to the drilling operation, such as weight on bit, torque, rotation rate, bending loads applied to the string, mud weights, temperature, pressure, and rate of penetration. The test bits are actuated under a variety of drilling and wellbore conditions and are operated until failure occurs. The recorded data can be utilized to establish thresholds which indicate impending bit failure during actual drilling operations. For a particular downhole drill bit type, the data is assessed to determine which particular sensor or sensors will provide the earliest and clearest indication of impending bit failure. Those sensors which do not provide an early and clear indication of failure will be discarded from further consideration. Only those sensors which provide such a clear and early indication of impending failure will be utilized in production downhole drill bits. Step 177 in FIGS. 7A and 7B corresponds to the step of identifying impending downhole drill bit failure indicators from the data amassed during simulated drilling operations.

In an alternative embodiment, field testing may be conducted to supplement the data obtained during simulated drilling operations, and the particular operating condition sensors which are eventually placed in production downhole drill bits selected based upon a combination of the data obtained during simulated drilling operations and the data obtained during field testing. In either event, in accordance with step 179, particular ones of the operating condition sensors are included in a particular type of production downhole drill bit. Then, a monitoring system is included in the production downhole drill bit, and is defined or programmed to continuously compare sensor data with a pre-established threshold for each sensor.

For example, and without limitation, the following types of thresholds can be established:

(1) maximum and minimum axial, shear, and/or bending strain may be set for bit legs 80, 81, or 82;

(2) maximum temperature thresholds may be established from the simulated drilling operations for journal bearings 96, 97, or 98;

(3) minimum pressure levels for the reservoir and/or seal interface may be established for lubrication systems 84, 85, or 86;

(4) maximum (x-axis, y-axis, and/or z-axis) acceleration may be established for bit body 55.

In particular embodiments, the temperature thresholds set for journal bearings 96, 97, or 98, and the pressure thresholds established for lubrication systems 94, 95, 96 may be relative figures which are established with respect to ambient pressure and ambient temperature in the wellbore during drilling operations as detected by ambient pressure sensor 151 and temperature sensor 153 (both of FIG. 6). Such thresholds may be established by providing program instructions to a controller which is resident within improved downhole drill bit 26, or by providing voltage and current thresholds for electronic circuits provided to continuously or intermittently compare data sensed in real time during drilling operations with pre-established thresholds for particular sensors which have been included in the production downhole drill bits. The step of programming the monitoring system is identified in the flowchart of FIGS. 7A and 7B as step 183.

Then, in accordance with step 185, drilling operations are performed and data is monitored to detect impending downhole drill bit failure by continuously comparing data measurements with pre-established and predefined thresholds (either minimum, maximum, or minimum and maximum thresholds). Then, in accordance with step 187, information is communicated to a data communication system such as a measurement-while-drilling telemetry system. Next, in accordance with step 189, the measurement-while-drilling telemetry system is utilized to communicate data to the surface. The drilling operator monitors this data and then adjusts drilling operations in response to such communication, in accordance with step 191.

The potential alarm conditions may be hierarchically arranged in order of seriousness, in order to allow the drilling operator to intelligently respond to potential alarm conditions. For example, loss of pressure within lubrication systems 84, 85, or 86 may define the most severe alarm condition. A secondary condition may be an elevation in temperature at journal bearings 96, 97, 98. Finally, an elevation in strain in bit legs 80, 81, 82 may define the next most severe alarm condition. Bit body acceleration may define an alarm condition which is relatively unimportant in comparison to the others. In one embodiment of the present invention, different identifiable alarm conditions may be communicated to the surface to allow the operator to exercise independent judgement in determining how to adjust drilling operations. In alternative embodiments, the alarm conditions may be combined to provide a composite alarm condition which is composed of the various available alarm conditions. For example, an arabic number between 1 and 10 may be communicated to the surface with 1 identifying a relatively low level of alarm, and 10 identifying a relatively high level of alarm. The various alarm components which are summed to provide this single numerical indication of alarm conditions may be weighted in accordance with relative importance. Under this particular embodiment, a loss of pressure within lubrication systems 84, 85, or 86 may carry a weight two or three times that of other alarm conditions in order to weight the composite indicator in a manner which emphasizes those alarm conditions which are deemed to be more important than other alarm conditions.

The types of responses available to the operator include an adjustment in the weight on bit, the torque, and the rotation rate applied to the drillstring. Alternatively, the operator may respond by including or excluding particular drilling additives to the drilling mud. Finally, the operator may respond by pulling the string and replacing the bit. A variety of other conventional operator options are available. After the operator performs the particular adjustments, the process ends in accordance with step 193.

8. EXEMPLARY SENSOR PLACEMENT AND FAILURE THRESHOLD DETERMINATION

Figure 8B:
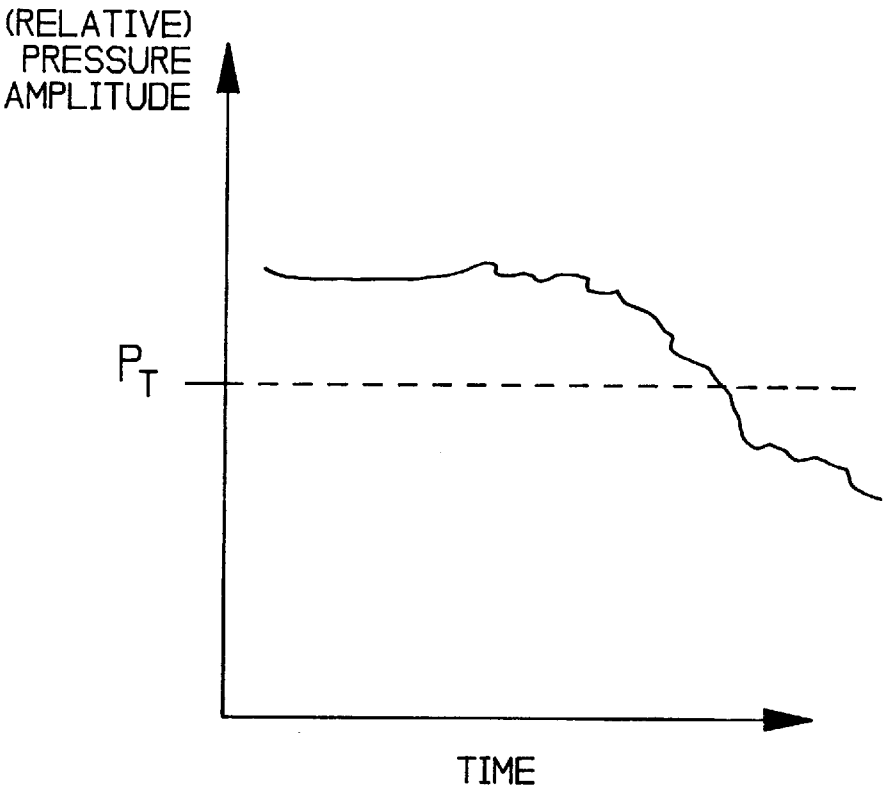
FIGS. 8A through 8H depict details of sensor placement on the improved downhole drill bit of the present invention, along with graphical representations of the types of data indicative of impending downhole drill bit failure.
Figure 8A:
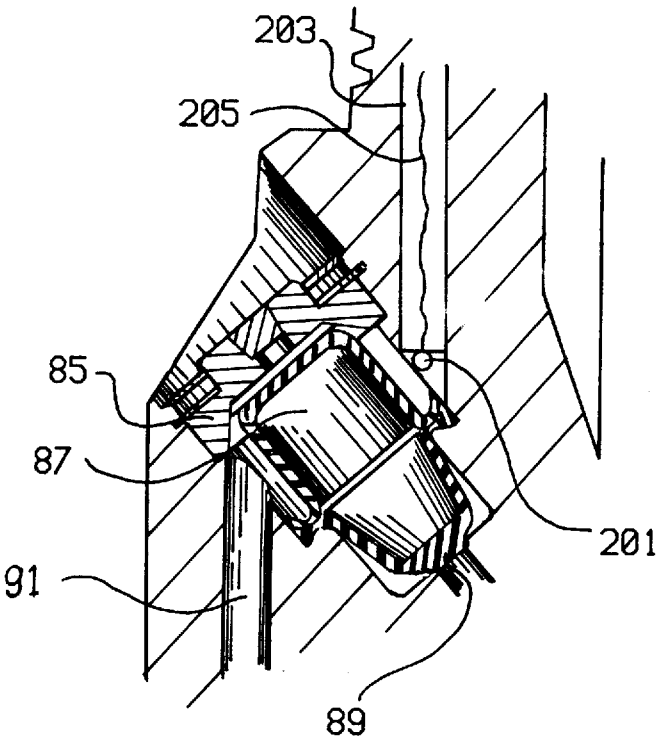

FIGS. 8A through 8H depict sensor placement in the improved downhole drill bit 26 of the present invention with corresponding graphical presentations of exemplary thresholds which may be established with respect to each particular operating condition being monitored by the particular sensor. FIGS. 8A and 8B relate to the monitoring of pressure in lubrication systems of the improved downhole drill bit 26. As is shown, pressure sensor 201 communicates with compensator 85 and provides an electrical signal through conductor 205 which provides an indication of the amplitude of the pressure within compensator 85. Conductor path 203 is provided through downhole drill bit 26 to allow the conductor to pass to the monitoring system carried by downhole drill bit 26. This measurement may be compared to ambient pressure to develop a measurement of the pressure differential across the seal. FIG. 8B is a graphical representation of the diminishment of pressure amplitude with respect to time as the seal integrity of compensator 85 is impaired. The pressure threshold $P_T$ is established. Once the monitoring system determines that the pressure within compensator 85 falls below this pressure threshold, an alarm condition is determined to exist.

Figure 8D:
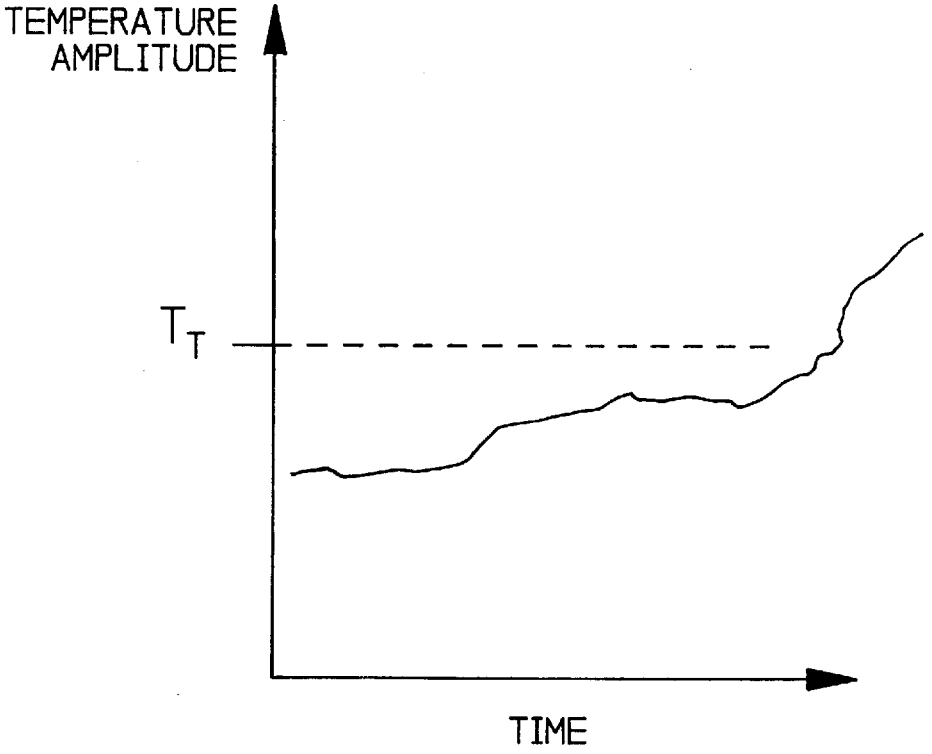
Figure 8C:
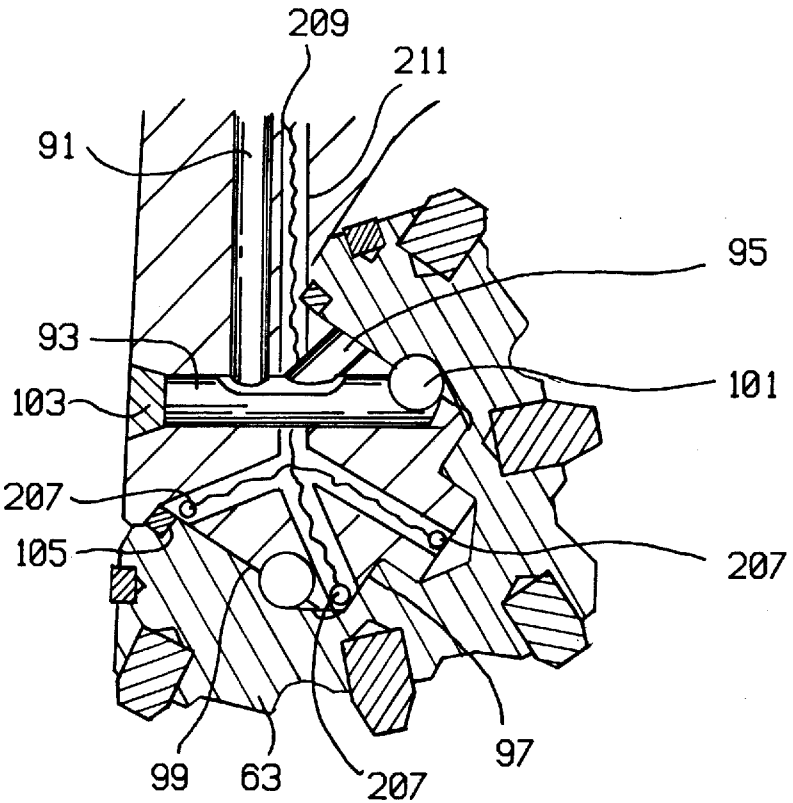

FIG. 8C depicts the placement of temperature sensors 207 relative to cantilevered journal bearing 97. Temperature sensors 207 are located at the cone mouth, shirt tail and thrust face of journal bearing 97, and communicate electrical signals via conductor 209 to the monitoring system to provide a measure of either the absolute or relative temperature amplitude. When relative temperature amplitude is provided, this temperature is computed with respect to the ambient temperature of the wellbore. Conductor path 211 is machined within downhole drill bit 26 to allow conductor 209 to pass to the monitoring system. FIG. 8D graphically depicts the elevation of temperature amplitude with respect to time as the lubrication system for journal bearing 97 fails. A temperature threshold $T_T$ is established to define the alarm condition. Temperatures which rise above the temperature threshold triggers an alarm condition.

Figure 8F:
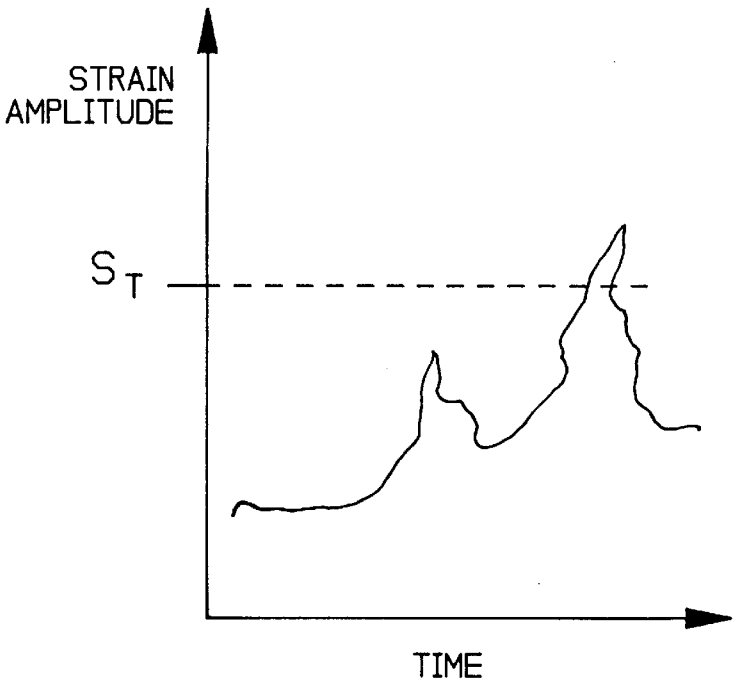
Figure 8E:
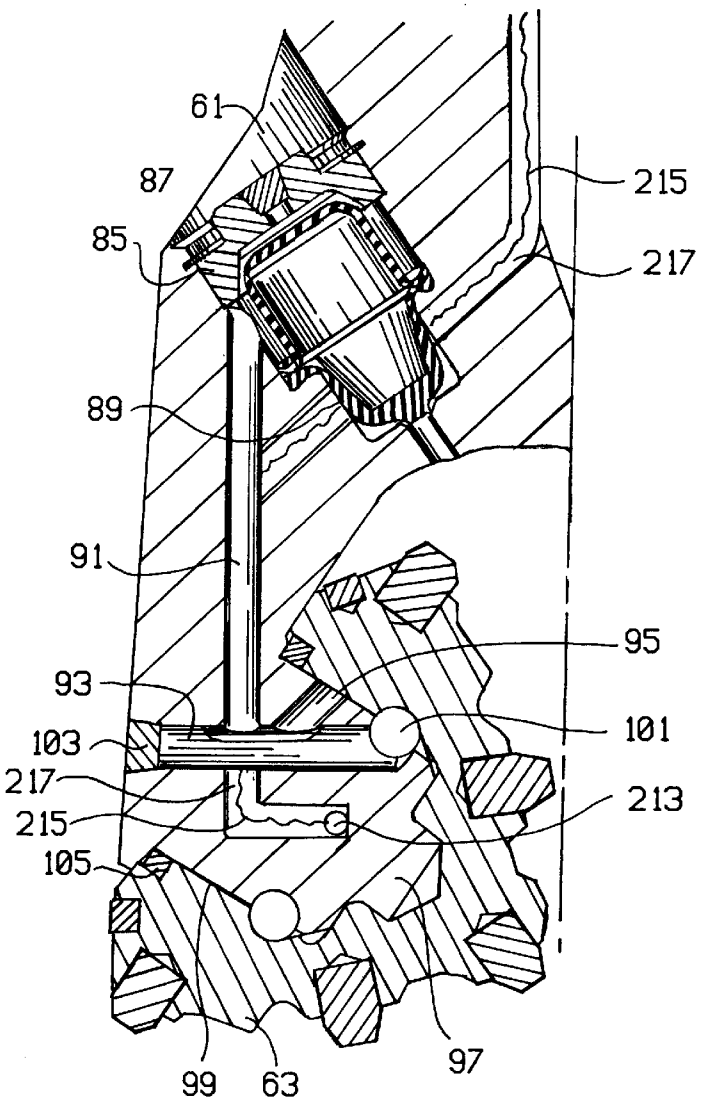
Figure 8H:
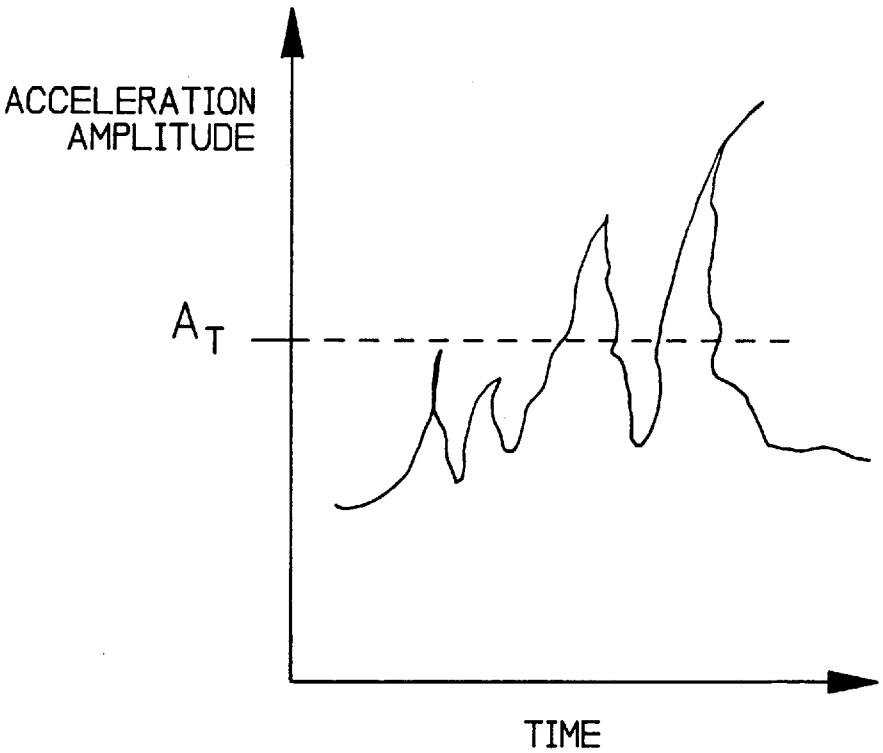
Figure 8G:
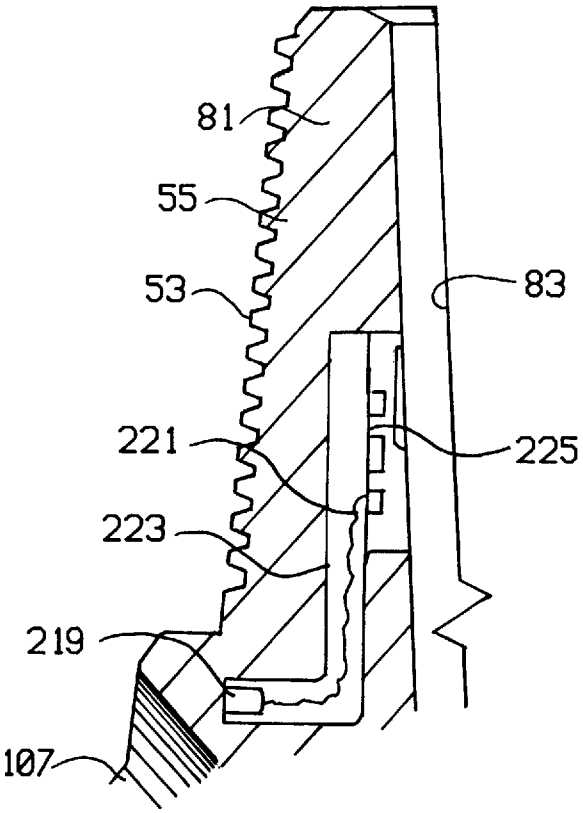

FIG. 8E depicts the location of strain sensors 213 relative to downhole drill bit 26. Strain sensors 213 communicate at least one signal which is indicative of at least one of axial strain, shear strain, and/or bending strain via conductors 215. These signals are provided to a monitoring system. Pathway 217 is defined within downhole drill bit 26 to allow for conductors 215 to pass to the monitoring system. FIG. 8F is graphical representation of strain amplitude with respect to time for a particular one of axial strain, shear strain, and/or bending strain. As is shown, a strain threshold $S_T$ may be established. Strain which exceeds the strain threshold triggers an alarm condition. FIG. 8G provides a representation of acceleration sensors 219 which provide an indication of the x-axis, y-axis, and/or z-axis acceleration of bit body 55. Conductors 221 pass through passage 223 to monitoring system 225. FIG. 8H provides a graphical representation of the acceleration amplitude with respect to time. An acceleration threshold $A_T$ may be established to define an alarm condition. When a particular acceleration exceeds the amplitude threshold, an alarm condition is determined to exist. While not depicted, the improved downhole drill bit 26 of the present invention may further include a pressure sensor for detecting ambient wellbore pressure, and a temperature sensor for detecting ambient wellbore temperatures. Data from such sensors allows for the calculation of a relative pressure or temperature threshold.

9. OVERVIEW OF OPTIONAL MONITORING SYSTEM

Figure 9:
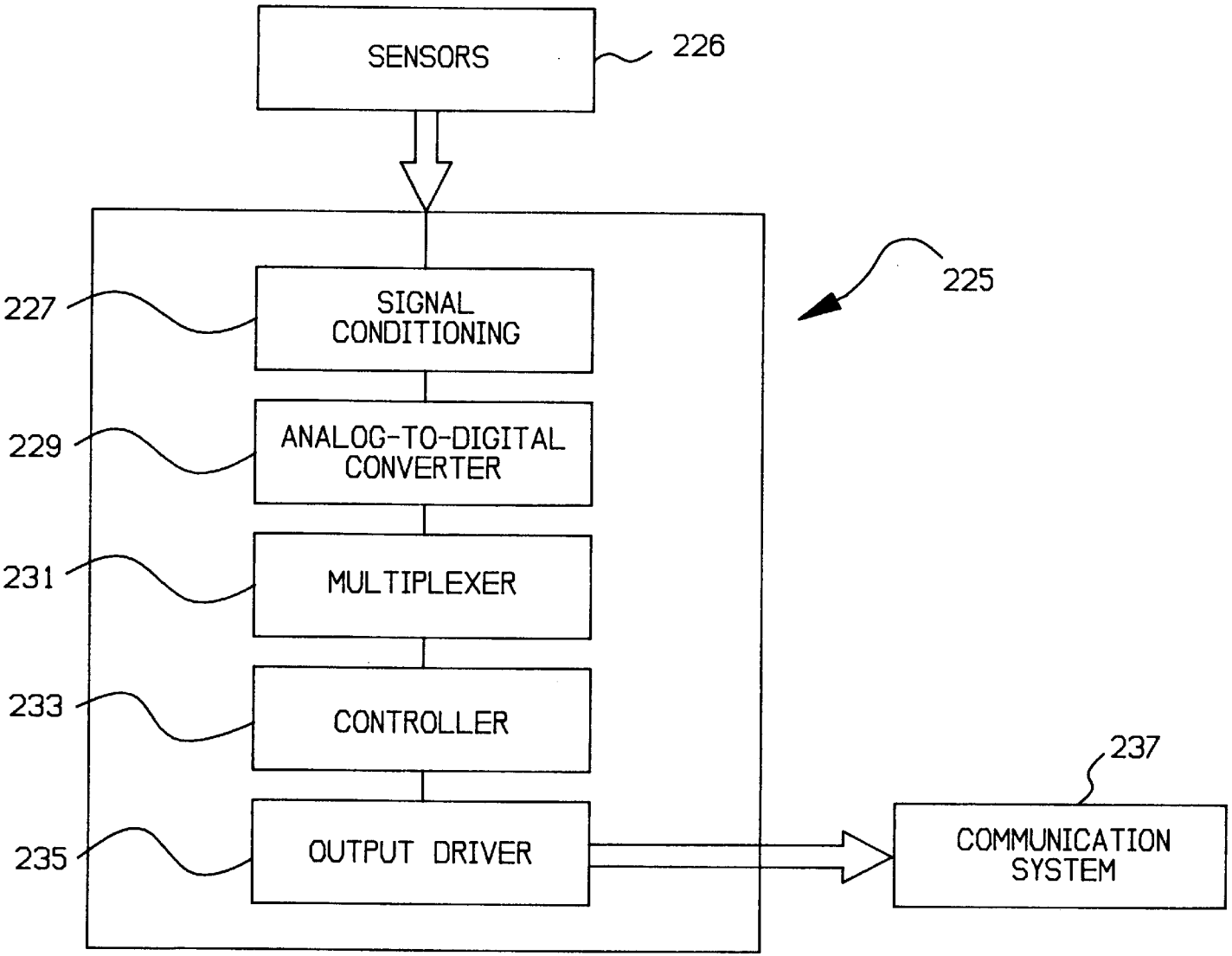
FIG. 9 is a block diagram representation of the monitoring system utilized in the improved downhole drill bit of the present invention.

FIG. 9 is a block diagram depiction of monitoring system 225 which is optionally carried by improved downhole drill bit 26. Monitoring system 225 receives real-time data from sensors 226, and subjects the analog signals to signal conditioning such as filtering and amplification at signal conditioning block 227. Then, monitoring system 225 subjects the analog signal to an analog-to-digital conversion at analog-to-digital converter 229. The digital signal is then multiplexed at multiplexer 231 and routed as input to controller 233. The controller continuously compares the amplitudes of the data signals (and, alternatively, the rates of change) to pre-established thresholds which are recorded in memory. Controller 223 provides an output through output driver 235 which provides a signal to communication system 237. In one preferred embodiment of the present invention, downhole drill bit 26 includes a communication system which is suited for communicating of either one or both of the raw data or one or more warning signals to a nearby subassembly in the drill collar. Communication system 237 would then be utilized to transmit either the raw data or warning signals a short distance through either electrical signals, electromagnetic signals, or acoustic signals. One available technique for communicating data signals to an adjoining subassembly in the drill collar is depicted, described, and claimed in U.S. Pat. No. 5,129,471 which issued on Jul. 14, 1992 to Howard, which is entitled "Wellbore Tool With Hall Effect Coupling", which is incorporated herein by reference as if fully set forth.

In accordance with the present invention, the monitoring system includes a predefined amount of memory which can be utilized for recording continuously or intermittently the operating condition sensor data. This data may be communicated directly to an adjoining tubular subassembly, or a composite failure indication signal may be communicated to an adjoining subassembly. In either event, substantially more data may be sampled and recorded than is communicated to the adjoining subassemblies for eventual communication to the surface through conventional mud pulse telemetry technology. It is useful to maintain this data in memory to allow review of the more detailed readings after the bit is retrieved from the wellbore. This information can be used by the operator to explain abnormal logs obtained during drilling operations. Additionally, it can be used to help the well operator select particular bits for future runs in the particular well.

10. UTILIZATION OF THE PRESENT INVENTION IN FIXED CUTTER DRILL BITS

Figure 10:
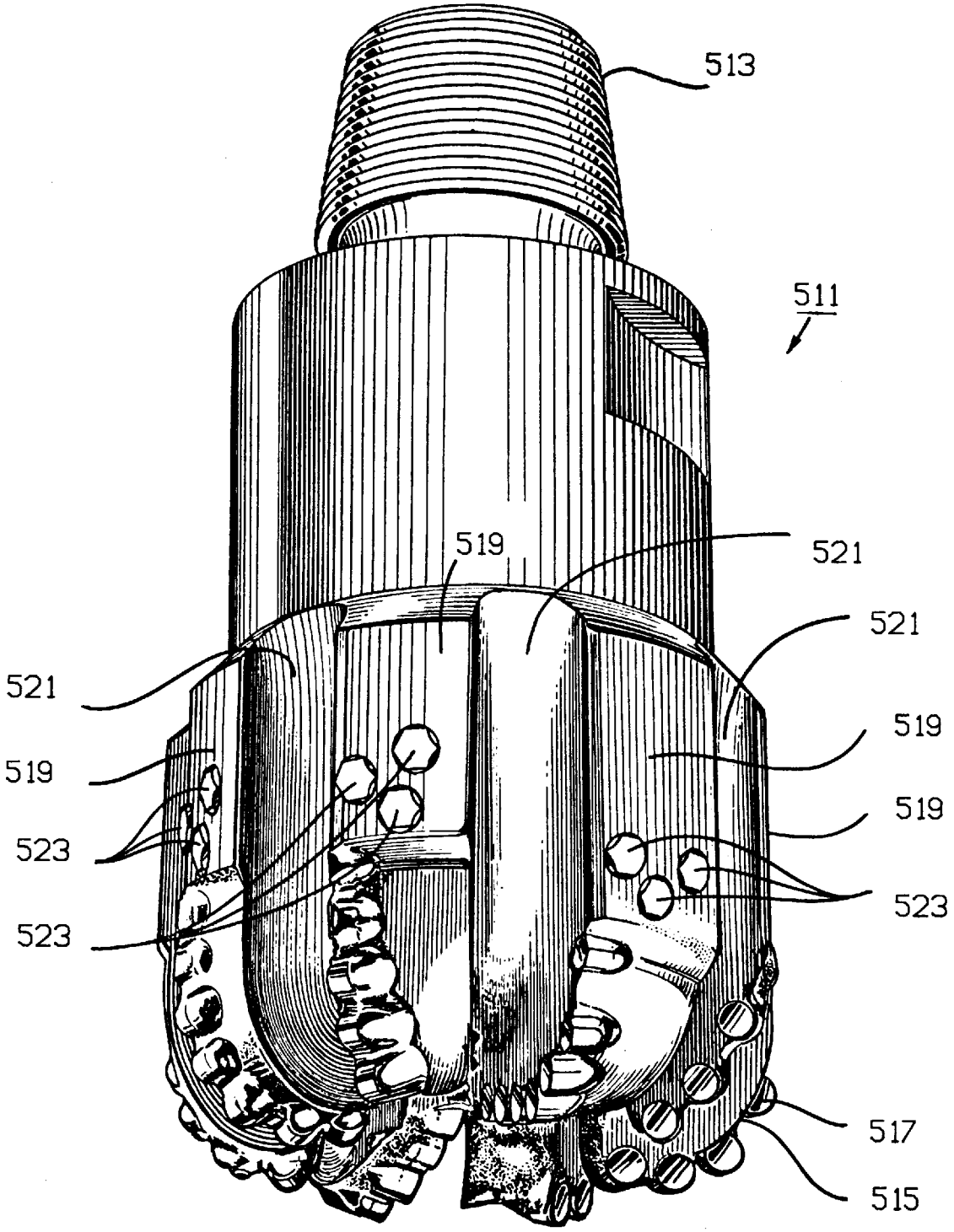
FIG. 10 is a perspective view of a fixed-cutter downhole drill bit.

The present invention may also be employed with fixed-cutter downhole drill bits. FIG. 10 is a perspective view of an earth-boring bit 511 of the fixed-cutter variety embodying the present invention. Bit 511 is threaded 513 at its upper extent for connection into a drillstring. A cutting end 515 at a generally opposite end of bit 511 is provided with a plurality of diamond or hard metal cutters 517, arranged about cutting end 515 to effect efficient disintegration of formation material as bit 511 is rotated in a borehole. A gage surface 519 extends upwardly from cutting end 515 and is proximal to and contacts the sidewall of the borehole during drilling operation of bit 511. A plurality of channels or grooves 521 extend from cutting end 515 through gage surface 519 to provide a clearance area for formation and removal of chips formed by cutters 517.

A plurality of gage inserts 523 are provided on gage surface 519 of bit 511. Active, shear cutting gage inserts 523 on gage surface 519 of bit 511 provide the ability to actively shear formation material at the sidewall of the borehole to provide improved gage-holding ability in earth-boring bits of the fixed cutter variety. Bit 511 is illustrated as a PDC ("polycrystalline diamond cutter") bit, but inserts 523 are equally useful in other fixed cutter or drag bits that include a gage surface for engagement with the sidewall of the borehole.

Figure 11:
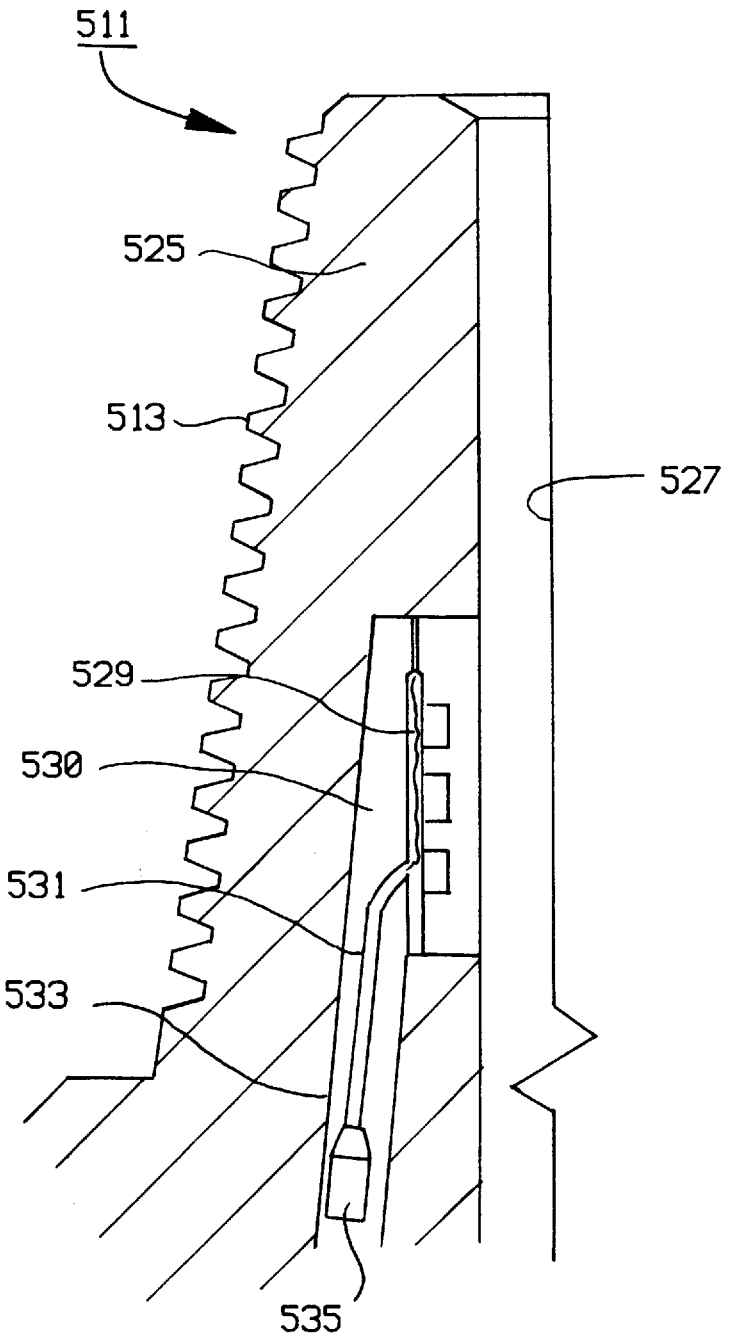
FIG. 11 is a fragmentary longitudinal section view of a portion of the fixed-cutter downhole drill bit of FIG. 10.

FIG. 11 is a fragmentary longitudinal section view of fixed-cutter downhole drill bit 511 of FIG. 10, with threads 513 and a portion of bit body 525 depicted. As is shown, central bore 527 passes centrally through fixed-cutter downhole drill bit 511. As is shown, monitoring system 529 is disposed in cavity 530. A conductor 531 extends downward through cavity 533 to accelerometers 535 which are provided to continuously measure the x-axis, y-axis, and/or z-axis components of acceleration of bit body 525. Accelerometers 535 provide a continuous measure of the acceleration, and monitoring system 529 continuously compares the acceleration to predefined acceleration thresholds which have been predetermined to indicate impending bit failure. For fixed-cutter downhole drill bits, whirl and stick-and-slip movement of the bit places extraordinary loads on the bit body and the PDC cutters, which may cause bit failure. The excessive loads cause compacts to become disengaged from the bit body, causing problems similar to those encountered when the rolling cones of a downhole drill bit are lost. Other problems associated with fixed cutter drill bits include bit "wobble" and bit "walling", which are undesirable operating conditions.

Fixed cutter drill bits differ from rotary cone rock bits in that rather complicated steering and drive subassemblies (such as a Moineau principle mud motor) are commonly closely associated with fixed cutter drill bits, and are utilized to provide for more precise and efficient drilling, and are especially useful in a directional drilling operation.

In such configurations, it may be advantageous to locate the memory and processing circuit components in a location which is proximate to the fixed cutter drill bit, but not actually in the drill bit itself. In these instances, a hardware communication system may be adequate for passing sensor data to a location within the drilling assembly for recordation in memory and optional processing operations.

While the invention has been shown in only one of its forms, it is not thus limited but is susceptible to various changes and modifications without departing from the spirit thereof.

What is claimed is:

1. An improved downhole drill bit for use in drilling operations in wellbores, comprising:

an integrally formed bit body;

at least one cutting structure carried on said integrally formed bit body;

a coupling member located at an upper portion of said intergrally formed bit body for securing said bit body to a drillstring;

at least one operating condition sensor located in and carried by said integrally formed bit body for monitoring at least one bit operating condition during drilling operations;

at least one semiconductor memory device, located in and carried by said integrally formed bit body, for recording in memory data pertaining to a likely failure condition for a time interval which is substantially co-extensive with said drilling operations; and an electrical power supply located in and carried by said integrally formed bit body for supplying electrical power to electrical power consuming components carried by said integrally formed bit body.

2. An improved downhole drill bit for use in drilling operations in wellbores, according to claim 1, further comprising:

at least one data reader member for recovering said data pertaining to said at least one bit operating condition which has been recorded by said at least one semiconductor memory device while drilling operations occur.

3. An improved downhole drill bit for use in drilling operations in wellbores, according to claim 1, further comprising:

at least one data reader member for recovering said data pertaining to said at least one bit operating condition which has been recorded by said at least one semiconductor memory device, while drilling operations occur.

4. An improved downhole drill bit for use in drilling operations in wellbores, according to claim 1, further comprising:

at least one data reader member for recovering said data pertaining to said at least one bit operating condition which has been recorded by said at least one semiconductor memory device, after said improved downhole drill bit is pulled from a wellbore.

5. An improved downhole drill bit for use in drilling operations in wellbores, according to claim 1, further comprising:

a communication system for communicating information away from said improved downhole drill bit during drilling operations.

6. An improved downhole drill bit for use in drilling operations in wellbores, according to claim 1, further comprising:

a communication system for communicating information from said improved downhole drill bit to at least one particular wellbore location.

7. An improved downhole drill bit for use in drilling operations in wellbores, according to claim 1, further comprising:

a communication system for communicating information from said improved downhole drill bit to a surface location.

8. An improved downhole drill bit for use in drilling operations in wellbores, according to claim 1, further comprising:

a communication system for communicating a warning signal from said improved downhole drill bit to at least one particular wellbore location.

9. An improved downhole drill bit for use in drilling operations in wellbores, according to claim 1, further comprising:

a processor member, located in and carried by said drill bit, for performing at least one predefined analysis of said data pertaining to said at least one bit operating condition which has been recorded by said at least one semiconductor memory device.

10. An improved downhole drill bit, in accordance with claim 9:

wherein said at least one predetermined analysis includes at least one of:

(a) analysis of strain at particular locations on said improved downhole drill bit;

(b) analysis of temperature at particular locations on said improved downhole drill bit;

(c) analysis of at least one operating condition in at least one lubrication system of said improved downhole drill bit; and (d) analysis of accelerations of said improved downhole drill bit.

11. An improved drill bit for use in drilling operations in wellbores, comprising:

a bit body;

a threaded coupling member formed at an upper portion of said bit body for connecting said bit body to a drill string;

at least one cutting structure carried by said bit body:

at least one bit failure sensor located in, and carried by, said drill bit body for monitoring at least one bit operating condition during drilling operations, which has been empirically determined to be predictive of likely bit failure;

at least one electronic memory device, located in and carried by said bit, for recording data pertaining to said at least one bit operating condition for a time interval which is substantially co-extensive with said drilling operation;

a data processor device, located in and carried by said bit body, for performing at least one predefined diagnostic analysis of said at least one bit operating condition in order to determine if bit failure is impending prior to the occurrence of bit failures; and an electrical power supply for supplying electrical power to at least said data processor device, located in and carried by said bit body.

12. An improved drill bit for use in drilling operations in wellbores, according to claim 11, further comprising:

at least one data reader member for recovering said data pertaining to said at least one operating condition which has been recorded by said at least one electronic memory device.

13. An improved drill bit for use in drilling operations in wellbores, according to claim 11, further comprising:

at least one data reader member for recovering said data pertaining to said at least one bit operating condition which has been recorded by said at least one electronic memory device, while drilling operations occur.

14. An improved drill bit for use in drilling operations in wellbores, according to claim 11, further comprising:

at least one data reader member for recovering said data pertaining to said at least one bit operating condition which has been recorded by said at least one electronic memory device, after said improved drill bit is pulled from a wellbore.

15. An improved drill bit for use in drilling operations in wellbores, according to claim 11, further comprising:

a communication system for communicating information away from said improved drill bit during drilling operations.

16. An improved drill bit for use in drilling operations in wellbores, according to claim 11, further comprising:

a communication system for communicating information from said improved drill bit to at least one particular wellbore location.

17. An improved drill bit for use in drilling operations in wellbores, according to claim 11, further comprising:

a communication system for communicating information from said improved drill bit to a surface location.

18. An improved drill bit for use in drilling operations in wellbores, according to claim 11, further comprising:

a communication system for communicating a warning signal from said improved drill bit to at least one particular wellbore location.

19. An improved drill bit, in accordance with claim 11:

wherein said at least one predetermined analysis includes at least one of:

(a) analysis of strain at particular locations on said improved drill bit;

(b) analysis of temperature at particular locations on said improved drill bit;

(c) analysis of at least one operating condition in at least one lubrication system of said improved drill bit; and (d) analysis of accelerations of said improved drill bit.

20. An improved drill bit for use in drilling operations in wellbores, according to claim 11:

wherein said at least one electronic memory device comprises at least one semiconductor memory device.

21. A method of monitoring for impending failure of a downhole drilling apparatus, during drilling operations in a wellbore, comprising the method steps of:

providing a drill bit assembly including at least one bit body;

providing at least one cutting structure on said bit body;

locating at least one operating condition sensor in said bit body;

locating at least one electronic memory unit in said bit body;

securing said drill bit assembly to a drillstring and lowering said drillstring into a wellbore;

disintegrating geologic formations with said drill bit assembly;

utilizing said at least one operating condition sensor to monitor at least one bit operating condition, which has been empirically determined to be predictive of likely bit failure, during said step of disintegrating geologic formations with said assembly; and recording in said at least one electronic memory data pertaining to said at least one bit operating condition during said step of disintegrating geologic formations with said assembly for a time interval which is substantially co-extensive with said drilling operation.

22. A method of monitoring for impending failure of a downhole drilling apparatus, during drilling operations in a wellbore, according to claim 21, further comprising;

communicating information to at least one particular wellbore location during said step of disintegrating geologic formations with said assembly.

23. A method of monitoring for impending failure of a downhole drilling apparatus, during drilling operations in a wellbore, according to claim 21, further comprising;

communicating information to a surface location during said step of disintegrating geologic formations with said assembly.

24. A method of monitoring for impending failure of a downhole drilling apparatus, during drilling operations in a wellbore, according to claim 21, further comprising:

locating a processing member in said bit body; and utilizing said processing member to perform at least one predetermined analysis of data pertaining to said at least one bit operating condition during said step of disintegrating geologic formations with said assembly.

25. A method of monitoring for impending failure of a downhole drilling apparatus, during drilling operations in a wellbore, according to claim 21, further comprising:

retrieving said assembly from said wellbore:

reviewing said data pertaining to said at least one operating condition.

26. A method of monitoring for impending failure of a downhole drilling apparatus, during drilling operations in a wellbore, according to claim 21, further comprising:

determining whether or not said drill bit has been utilized in an appropriate manner from said data pertaining to said at least one bit operating condition.

27. A method of monitoring for impending failure of a drill bit, during drilling operations in a wellbore, comprising the method steps of:

providing a drill bit including a bit body;

locating at least one bit failure condition sensor in said bit body;

locating at least one electronic memory unit in said bit body, which has been empirically determined to be predictive of impending bit failure before failure occurs;

securing said drill bit to a drillstring and lowering said drillstring into a wellbore;

disintegrating geologic formations with said drill bit;

utilizing said at least one bit failure condition sensor to monitor at least one bit operating condition during said step of disintegrating geologic formations with said drill bit;

recording in said at least one electronic memory data pertaining to said at least one bit operating condition during said step of disintegrating geologic formations with said drill bit for a time interval which is substantially co-extensive with said drilling operation;

locating a data processor device in said bit body; and performing during drilling operations at least one predefined diagnostic analysis in order to determine if bit failure is impending prior to the occurrence of bit failure.

28. A method of monitoring for impending failure of a drill bit, during drilling operations in a wellbore, according to claim 27, further comprising;

communicating information to at least one particular wellbore location during said step of disintegrating geologic formations with said drill bit.

29. A method of monitoring for impending failure of a drill bit, during drilling operations in a wellbore, according to claim 27, further comprising;

communicating information to a surface location during said step of disintegrating geologic formations with said drill bit.

30. A method of monitoring for impending failure of a drill bit, during drilling operations in a wellbore, according to claim 27, further comprising:

retrieving said drill bit from said wellbore:

reviewing said data pertaining to said at least one bit operating condition.

31. A method of monitoring for impending failure of a drill bit, during drilling operations in a wellbore, according to claim 30, further comprising:

determining whether or not said drill bit has been utilized in an appropriate manner from said data pertaining to said at least one bit operating condition.

32. A method of monitoring at least one operating condition of a drill bit during drilling operations, comprising:

placing a plurality of operating condition sensors on at least one test drill bit;

subjecting said at least one test drill bit to at least one drilling operation;

recording data with plurality of operating condition sensors;

identifying impending drill bit failure indicators in said data;

including selected ones of said plurality of operating condition sensors in a production drill bit;

including in said production drill bit a monitoring system for comparing data obtained during drilling operations with particular ones of said impending drill bit failure indicators;

conducting drilling operations with said production drill bit;

utilizing said monitoring system during drilling operations to identify impending drill bit failure; and telemetering data uphole during drilling operations to provide an indication of impending drill bit failure.

33. A method of monitoring at least one operating condition of a drill bit during drilling operations, according to claim 32:

wherein said monitoring system is carried within said production drill bit.

34. A method of monitoring at least one operating condition of a drill bit during drilling operations, according to claim 32, further comprising:

utilizing said monitoring system to record data from said selected ones of said plurality of operating condition sensors during drilling operations.

35. A method of monitoring at least one operating condition of a drill bit during drilling operations, according to claim 34, further comprising:

retrieving said monitoring system with said production drill bit; and examining data recorded in said monitoring system.

36. A method of monitoring at least one operating condition of a drill bit during drilling operations, according to claim 32, wherein said plurality of operating condition sensors comprise at least one of the following operating condition sensor:

(a) strain sensors located in at least one bit leg of said at least one test drill bit for sensing at least one of (1) axial strain, (2) shear strain, and (3) bending strain;

(b) temperature sensors located in at least one bearing of said at least one test drill bit for measuring at least one of (1) temperature at a cone mouth of said bearing, (2) temperature at a thrust face of said bearing, and (3) temperature at a shirt tail of said bearing;

(c) lubrication system sensors located in at least one lubrication system of said test drill bit for measuring at least one of (1) reservoir pressure, and (2) seal pressure;

(d) at least one accelerometer for measuring acceleration of a bit body of said at east one test drill bit; and (e) a wellbore sensor for monitoring at least one of (1) ambient pressure in said wellbore, and (2) ambient temperature in said wellbore.

37. A method of monitoring at least one operating condition of a drill bit during drilling operations, according to claim 32, wherein said monitoring system includes:

a programmable controller which includes program instructions and which initiates a warning signal if at least one predefined impending failure criteria is met during monitoring operations.

38. A method of monitoring at least one operating condition of a drill bit during drilling operations, according to claim 32, wherein said stop of telemetering data includes:

communicating data from said production drill bit to a reception apparatus located in a tubular subassembly proximate and production drill bit.

39. A method of monitoring at least one operating condition of a drill bit during drilling operations, according to claim 32, wherein said step of telemetering data includes:

communicating data from said production drill bit to a reception apparatus located in a tubular subassembly proximate said production drill bit; and providing a measurement-while-drilling mud pulse telemetry communication system;

utilizing said measurement-while-drilling mud pulse telemetry system to communicate an indication of impending drill bit failure to surface equipment.

40. A method of monitoring at least one operating condition of a drill bit during drilling operations, according to claim 32, further comprising:

subjecting said at least one test drill bit to at least one field test drilling operation; and recording data with said plurality of operating condition sensors during both of said at least one simulated drilling operation, and said at least one field test drilling operation; and identifying impending drill bit failure indicators in data accumulated during said at least one simulated drilling operation and said at least one field test drilling operation.

41. An improved drilling apparatus for use in drilling operations in wellbores, comprising:

a bit assembly including a bit body;

a threaded coupling member formed at an upper portion of said bit body;

at least one operating condition sensor carried by said drill bit for monitoring at least one of: (1) temperature, (2) pressure, (3) strain, and (4) acceleration; and providing at least one output signal indicative thereof;

a comparator carried in said bit assembly for (1) receiving said at least one output signal (2) comparing said at least one output signal to at least one predefined impending failure threshold and (3) communicating an impending failure signal.

42. An improved drill bit according to claim 41, wherein said at least one operating condition sensor comprises at least one of the following operating condition sensor:

(a) strain sensors located in at least one bit leg of said drill bit for sensing at least one of (1) axial strain, (2) shear strain, and (3) bending strain;

(b) temperature sensors located in at least one bearing of said drill bit for measuring at least one of (1) temperature at a cone mouth of said bearing, (2) temperature at a thrust face of said bearing, and (3) temperature at a shirt tail of said bearing;

(c) lubrication system sensors located in at least one lubrication system of said drill bit for measuring at least one of (1) reservoir pressure, and (2) seal pressure;

(d) at least one accelerometer for measuring acceleration of a bit body of said drill bit; and (e) a wellbore sensor for monitoring at least one of (1) ambient pressure in said wellbore, and (2) ambient temperature in said wellbore.

43. An improved drill bit according to claim 41, wherein said comparator communicates an impending failure signal to a reception apparatus located in a tubular subassembly proximate said drill bit.

44. An improved drill bit for use in drilling operations in a wellbore, comprising:

an integrally-formed bit body;

a coupling member formed at an upper portion of said integrally-formed bit body to allow connection to a drillstring;

at least one operating condition sensor carried within said integrally-formed bit body for monitoring at least one operating condition during drilling operations;

at least one memory member, located in and carried by said integrally-formed bit body, for recording in memory data pertaining to said at least one operating condition for a time interval which is substantially co-extensive with said drilling operations, without any required interaction with any other component of said drillstring; and;

an electrical power supply carried by said integrally formed bit body for supplying electrical power to at least said at least one memory member during drilling operations.

45. An improved drill bit for use in drilling operations in a wellbore, according to claim 44, further comprising:

at least one data reader member for recovering said data pertaining to said at least one operating condition which has been recorded by said at least one memory member.

46. An improved drill bit for use in drilling operations in a wellbore, according to claim 44, further comprising:

at least one data reader member for recovering said data pertaining to said at least one operating condition which has been recorded by said at least one memory member, while drilling operations occur.

47. An improved drill bit for use in drilling operations in a wellbore, according to claim 44, further comprising:

at least one data reader member for recovering said data pertaining to said at least one operating condition which has been recorded by said at least one memory member, after said improved drill bit is pulled from a wellbore.

48. An improved drill bit for use in drilling operations in a wellbore, according to claim 44, further comprising:

a communication system for communicating information away from said improved drill bit during drilling operations.

49. An improved drill bit for use in drilling operations in a wellbore, according to claim 44, further comprising:

a communication system for communicating information from said improved drill bit to at least one particular wellbore location.

50. An improved drill bit for use in drilling operations in a wellbore, according to claim 44, further comprising:

a communication system for communicating information from said improved drill bit to a surface location.

51. An improved drill bit for use in drilling operations in a wellbore, according to claim 44, further comprising:

a communication system for communicating a warning signal from said improved drill bit to at least one particular wellbore location.

52. An improved drill bit for use in drilling operations in a wellbore, according to claim 44, further comprising:

a processor member, located in and carried by integrally-formed bit body, for performing at least one predefined analysis of said data pertaining to said at least one operating condition which has been recorded by said at least one memory member.

53. An improved drill bit, in accordance with claim 52:

wherein said at least one predetermined analysis includes at least one of:

(a) analysis of strain at particular locations on said improved drill bit;

(b) analysis of temperature at particular locations on said improved drill bit;

(c) analysis of at least one operating condition in at least one lubrication system of said improved drill bit; and (d) analysis of accelerations of said improved drill bit.

54. An improved drill bit for use in drilling operations in a wellbore, according to claim 44:

wherein said at least one memory member comprises at least one semiconductor memory device.

55. A method of monitoring at least one operating condition of a drill bit, during drilling operations in a wellbore, comprising:

providing a drill bit including an integrally-formed bit body;

locating at least one operating condition sensor in said integrally-formed bit body;

locating at least one electronic memory unit in said integrally-formed bit body;

securing said drill bit to a drillstring and lowering said drillstring into a wellbore;

disintegrating geologic formations with said drill bit;

providing an electrical power supply for supplying electrical power to at least said at least one electronic memory unit during drilling operations; utilizing said at least one operating condition sensor to monitor at least one operating condition during said step of disintegrating geologic formations with said drill bit; and recording in said at least one electronic memory data pertaining to said at least one operating condition during said step of disintegrating geologic formations with said drill bit for a time interval which is substantially co-extensive with said drilling operation, without any required interaction with any other component of said drillstring.

56. A method of monitoring at least one operating condition of a drill bit, during drilling operations in a wellbore, according to claim 55, further comprising;

communicating information to at least one particular wellbore location during said step of disintegrating geologic formations with said drill bit.

57. A method of monitoring at least one operating condition of a drill bit, during drilling operations in a wellbore, according to claim 55, further comprising;

communicating information to a surface location during said step of disintegrating geologic formations with said drill bit.

58. A method of monitoring at least one operating condition of a drill bit, during drilling operations in a wellbore, according to claim 55, further comprising:

locating a processing member in said drill bit; and utilizing said processing member to perform at least one predetermined analysis of data pertaining to said at least one operating condition during said step of disintegrating geologic formations with said drill bit.

59. A method according to claim 58 wherein said at least one predetermined analysis includes at least one of:

(a) analysis of strain at particular locations on said drill bit;

(b) analysis of temperature at particular locations on said drill bit;

(c) analysis of at least one operating condition in at least one lubrication system of said drill bit:

(d) analysis of accelerations of said drill bit.

60. A method of monitoring at least one operating condition of a drill bit, during drilling operations in a wellbore, according to claim 55, further comprising:

retrieving said drill bit from said wellbore:

reviewing said data pertaining to said at least one operating condition.

61. A method of monitoring at least one operating condition of a drill bit, during drilling operations in a wellbore, according to claim 60, further comprising:

determining whether or not said drill bit has been utilized in an appropriate manner from said data pertaining to said at least one operating condition.

62. An improved drill bit for use in drilling operations in a wellbore, comprising:

a bit body including a plurality of bit heads, each supporting a rolling cone cutter;

a coupling member formed at an upper portion of said bit body;

at least one operating condition sensor carried by said bit body for monitoring at least one operating condition during drilling operations;

at least one memory member, located in and carried by said bit body, for recording in memory data pertaining to said at least one operating condition for a time interval which is substantially co-extensive with said drilling operation, without any required interaction with any other component of said drilling; and an electrical power supply carried by said integrally formed bit body for supplying power to at least said at least one memory member during drilling operations.

63. An improved drill bit for use in drilling operations in a wellbore, according to claim 62, further comprising:

at least one data reader member for recovering said data pertaining to said at least one operating condition which has been recorded by said at least one memory member.

64. An improved drill bit for use in drilling operations in a wellbore, according to claim 62, further comprising:

at least one data reader member for recovering said data pertaining to said at least one operating condition which has been recorded by said at least one memory member, while drilling operations occur.

65. An improved drill bit for use in drilling operations in a wellbore, according to claim 62, further comprising:

at least one data reader member for recovering said data pertaining to said at least one operating condition which has been recorded by said at least one memory member, after said improved drill bit is pulled from a wellbore.

66. An improved drill bit for use in drilling operations in a wellbore, according to claim 62, further comprising:

a communication system for communicating information away from said improved drill bit during drilling operations.

67. An improved drill bit for use in drilling operations in a wellbore, according to claim 62, further comprising:

a communication system for communicating information from said improved drill bit to at least one particular wellbore location.

68. An improved drill bit for use in drilling operations in a wellbore, according to claim 62, further comprising:

a communication system for communicating information from said improved drill bit to a surface location.

69. An improved drill bit for use in drilling operations in a wellbore, according to claim 62, further comprising:

a communication system for communicating a warning signal from said improved drill bit to at least one particular wellbore location.

70. An improved drill bit for use in drilling operations in a wellbore, according to claim 62, further comprising:

a processor member, located in and carried by said bit body, for performing at least one predefined analysis of said data pertaining to said at least one operating condition which has been recorded by said at least one memory member.

71. An improved drill bit, in accordance with claim 70:

wherein said at least one predetermined analysis includes at least one of:

(a) analysis of strain at particular locations on said improved drill bit;

(b) analysis of temperature at particular locations on said improved drill bit;

(c) analysis of at least one operating condition in at least one lubrication system of said improved drill bit; and (d) analysis of accelerations of said improved drill bit.

72. An improved drill bit for use in drilling operations in a wellbore, according to claim 62:

wherein said at least one memory member comprises at least one semiconductor memory device.

73. A method of monitoring at least one operating condition of a drill bit, during drilling operations in a wellbore, comprising:

providing a drill bit including a bit body which includes a plurality of bit heads, each supporting a rolling cone cutter;

locating at least one operating condition sensor in said bit body;

locating at least one electronic memory unit in said bit body;

locating an electrical power supply in said bit body for supplying electrical power to at least sat at least one memory member during drilling operations;

securing said drill bit to a drillstring and lowering said drillstring into a wellbore;

disintegrating geologic formations with said assembly;

utilizing said at least one operating condition sensor to monitor at least one operating condition during said step of disintegrating geologic formations with said drill bit; and recording in said at least one electronic memory data pertaining to said at least one operating condition during said step of desintegrating geologic formations with said drill bit for a time interval which is substantially co-extensive with said drilling operation, without any required interaction with any other component of said drillstring.

74. A method of monitoring at least one operating condition of a drill bit, during drilling operations in a wellbore, according to claim 73, further comprising:

communicating information to at least one particular wellbore location during said step of disintegrating geologic formations with said drill bit.

75. A method of monitoring at least one operating condition of a drill bit, during drilling operations in a wellbore, according to claim 73, further comprising:

communicating information to a surface location during said step of disintegrating geologic formations with said drill bit.

76. A method of monitoring at least one operating condition of a drill bit, during drilling operations in a wellbore, according to claim 73, further comprising:

locating a processing member in said bit body; and utilizing said processing member to perform at least one predetermined analysis of data pertaining to said at least one operating condition during said step of disintegrating geologic formations with said drill bit.

77. A method according to claim 76, wherein said at least one predetermined analysis includes at least one of:

(a) analysis of strain at particular locations on said drill bit;

(b) analysis of temperature at particular locations on said drill bit;

(c) analysis of at least one operating condition in at least one lubrication system of said drill bit;

(d) analysis of accelerations of said drill bit.

78. A method of monitoring at least one operating condition of a drill bit, during drilling operations in a wellbore, according to claim 73, further comprising:

retrieving said drill bit from said wellbore:

reviewing said data pertaining to said at least one operating condition.

79. A method of monitoring at least one operating condition of a drill bit, during drilling operations in a wellbore, according to claim 78, further comprising:

determining whether or not said drill bit has been utilized in an appropriate manner from said data pertaining to said at least one operating condition.

80. An improved drilling apparatus for use in drilling operations in wellbores, comprising:

a bit body;

a cutting structure carried by said bit body;

a communication system located in said wellbore and communicatively coupled to said improved drilling apparatus;

at least one operating condition sensor located in and carried by said drilling apparatus in said bit body for monitoring at least one of: (1) temperature, (2) pressure, (3) strain, and (4) acceleration, and providing at least one output signal indicative thereof;

a comparator for (1) receiving said at least one output signal (2) comparing said at least one output signal to at least one predefined diagnostic threshold and reaching a diagnostic conclusion (3) communicating a signal representative of said diagnostic conclusion concerning an operating condition of said drilling apparatus utilizing said communication system.

81. An improved drilling apparatus according to claim 80, wherein said at least one operating condition sensor comprises at least one of the following operating condition sensor:

(a) strain sensors located for sensing at least one of (1) axial strain, (2) shear strain, and (3) bending strain;

(b) temperature sensors located in at least one bearing of said drill bit;

(c) lubrication system sensors located in at least one lubrication system of said drill bit;

(d) at least one accelerometer for measuring acceleration of said bit body of said drill bit.

82. An improved drilling apparatus for use in drilling operations in wellbores, comprising:

a bit body;

a cutting structure carried by said bit body;

a communication system located in said wellbore and communicatively coupled to said improved drilling apparatus;

at least one operating condition sensor located in and carried by said drilling apparatus in said bit body for monitoring at least one of: (1) temperature, (2) pressure, (3) strain, and (4) acceleration, and providing at least one output signal indicative, thereof;

a data processing system including a controller and data processing instructions for (1) receiving said at least one output signal (2) executing program instructions for comparing said at least one output signal to at least one predefined diagnostic threshold and reaching a diagnostic conclusion (3) executing program instructions for communicating a signal representative of said diagnostic conclusion concerning an operating condition of said drilling apparatus utilizing said communication system.

83. An improved drilling apparatus according to claim 82, wherein said at least one operating condition sensor comprises at least one of the following operating condition sensor:

(a) strain sensors located for sensing at least one of (1) axial strain, (2) shear strain, and (3) bending strain;

(b) temperature sensors located in at least one bearing of said drill bit;

(c) lubrication system sensors located in at least one lubrication system of said drill bit;

(d) at least one accelerometer for measuring acceleration of said bit body of said drill bit.

84. An improved drilling apparatus for use in drilling operations in a wellbore, comprising:

an integrally-formed bit body;

a coupling member formed at an upper portion of said integrally-formed bit body to allow connection to a drillstring;

a communication system located in said wellbore and communicatively coupled to said improved drilling apparatus;

at least one operating condition sensor carried within said integrally-formed bit body for monitoring at least one operating condition during drilling operations;

at least one electronic memory member, located in and carried by said integrally-formed bit body, for recording in memory data pertaining to said at least one operating condition for a time interval which is substantially co-extensive with said drilling operations, without any required interaction with any other component of said drillstring;

a data processing system including a controller and data processing instructions for:

(a) receiving data from said at least one operating condition sensor during drilling operations;

(b) comparing said data to at least one predefined diagnostic threshold;

(c) reaching a diagnostic conclusion concerning an operating condition of said drilling apparatus;

(d) interacting with said communication system to communicate a signal representative of said diagnostic conclusion;

an electrical power supply carried by said integrally formed bit body for supplying electrical power to at least said data processing system and said at least one memory member during drilling operations.

85. An improved drill bit for use in drilling operations in a wellbore, according to claim 84, further comprising:

at least one data reader member for recovering said data pertaining to said at least one operating condition which has been recorded by said at least one memory member.

86. An improved drill bit for use in drilling operations in a wellbore, according to claim 84, further comprising:

at least one data reader member for recovering said data pertaining to said at least one operating condition which has been recorded by said at least one memory member, while drilling operations occur.

87. An improved drill bit for use in drilling operations in a wellbore, according to claim 84, further comprising:

at least one data reader member for recovering said data pertaining to said at least one operating condition which has been recorded by said at least one memory member, after said improved drill bit is pulled from a wellbore.

88. An improved drill bit, in accordance with claim 84:

wherein said at least one predetermined analysis includes at least one of:

(a) analysis of strain at particular locations on said improved bit body;

(b) analysis of temperature at particular locations on said bit body;

(c) analysis of at least one operating condition in at least one lubrication system of said improved drilling apparatus; and (d) analysis of accelerations of said bit body.

* * * * *